US005920756A

United States Patent [19]

Matsuda et al.

[11] Patent Number: 5,920,756

[45] Date of Patent: Jul. 6, 1999

[54] IMAGE FORMING METHOD AND APPARATUS HAVING A RECORDING MEDIUM

[75] Inventors: Tsukasa Matsuda; Nobuhiro Katsuta; Kazuhiko Arai, all of Kanagawa, Japan

[73] Assignee: Fuji Xerox Co., Ltd., Tokyo, Japan

[21] Appl. No.: 08/910,040

[22] Filed: Aug. 12, 1997

[30] Foreign Application Priority Data

Aug. 23, 1996 [JP] Japan ..... 8-222516

[51] Int. Cl.[6] ..... G03G 15/16; G03G 15/20

[52] U.S. Cl. ..... 399/307; 399/308; 430/47; 430/126

[58] Field of Search ..... 399/307, 308, 399/302; 430/45, 47, 126

[56] References Cited

U.S. PATENT DOCUMENTS 4,968,578 11/1990 Light et al. .
5,023,038 6/1991 Aslam et al. .
5,089,363 2/1992 Rimai et al. .
5,308,733 5/1994 Rimai et al. .
5,428,430 6/1995 Aslam et al. ..... 399/307
5,536,609 7/1996 Jackson et al. .

FOREIGN PATENT DOCUMENTS

A 63-92965 4/1988 Japan .
A 5-216322 8/1993 Japan .
A 5-273781 10/1993 Japan .

*Primary Examiner*—Richard Moses
*Attorney, Agent, or Firm*—Oliff & Berridge, PLC

[57] ABSTRACT

An image forming method is provided which is structured in such a way that a toner image carried to a transferring position by a toner image holding member for holding and carrying the toner image from a toner image forming position to the toner image transferring position is transferred to a predetermined recording medium. The image forming method includes carrying a toner image into close contact with a recording medium and transferring and fixing the toner image while heating the toner image. A recording medium is employed which has a thermoplastic transparent resin layer on at least a surface of a base thereof on which the toner image is transferred and the softening point (Tmp) of the transparent resin is in the range from 1° C. to 30° C. lower than the softening point (Tmt) of the toner.

17 Claims, 10 Drawing Sheets

<CONDITION>

TONER : 7μm POLYESTER TONER
QUANTITY OF TRANSFERRED TONER
: 0.65mg/cm²

<CONDITION>

TONER : 7μm POLYESTER TONER
QUANTITY OF TRANSFERRED TONER
: 0.65mg/cm²

IMAGE FORMING METHOD AND APPARATUS HAVING A RECORDING MEDIUM

BACKGROUND OF THE INVENTION

The present invention relates to an image forming method, an image forming apparatus and a recording medium for use in the method and the apparatus, which enable a printer, a copying machine or the like employing a simultaneous transferring and fixing method, with which a toner image formed by an indirect electrophotographic method is transferred to the surface of a recording medium and the toner image is fixed to the recording medium when the toner image is transferred, to have an excellent glossiness and image quality.

In recent years, a digital indirect electrophotographic method of forming a color image has been widely used. In general, the digital indirect and dry electrophotographic method is structured in such a manner that yellow, magenta, cyan and black toners each of which has been prepared by mixing a coloring matter, such as pigment and/or dye, with thermoplastic resin is electrostatically held on the surface of a photosensitive member, which is an image carrier which has been digitally addressed with exposing light formed by converting image information into light information so that a toner image is formed; the toner image is electrostatically transferred to a recording medium; and the toner image is melted and fixed with heat and pressure so that an image is formed.

In general, the toner for use in the indirect and dry electrophotographic method has particle sizes of 5 $\mu$m to 12 $\mu$m, and each color toner is transferred to the recording medium by a weight of 0.3 mg/cm$^2$ to 1.2 mg/cm$^2$. The thermoplastic toner is transferred to one- to four-layered recording medium. When the toner is melted with heat, it is softened and brought into a molten state. However, the overall body of the toner does not fully penetrate into the paper, which is a usual recording medium even after the toner has been heated and pressed. The toner swells by about 5 $\mu$m to about 20 $\mu$m over the recording medium.

The relationship between the area ratio of the thus-formed image, that is, input to the recording medium and gloss of the image is shown in FIG. 1. FIG. 1 shows results of measurement of 75°-specular gloss of images formed by a method conforming to JIS P8142 in such a manner that magenta images are formed on cast coat paper (enamel coat/Yonago Kako Seishi Kabushiki Kaisha) which is high glossy paper, J-coat paper (Fuji Xerox) which is medium glossy paper and J-paper (Fuji Xerox) which is low glossy and non-coated plain paper are used as the recording mediums by using a multi-line screen such that the input image area ratio is varied. FIG. 2 shows an image profile of a portion of an image which has been formed on the cast coat paper as described above, which is obtained by a 3D surface roughness meter and in which the image area ratio is 40%. As can be understood from FIGS. 1 and 2, solid image portions have a relatively high glossiness. However, incident light is scattered considerably in halftone regions and highlighted regions because the multilines and dots are in the form of convex over the recording medium. Therefore, if an image, such as a image of a human being or the like, having relatively steep gradient is formed, an image having high gloss regions and low gloss regions mixed with one another is formed, thus resulting in a sense of incompatibility being allowed to arise. A fact is known that a rough surface image of the foregoing type suffers from unsatisfactory color reproducibility owning to an influence of irregular reflection on the surface of the image and thus an image having insufficient visibility is formed. Another fact is known that an image having a rough surface and formed on a transparent recording medium is, in a case of an projection operation using an OHP, encounters deterioration in the color developing characteristic.

To improve the quality of a color image of the foregoing type, a method has been suggested in the Unexamined Japanese Patent Application Publication No. Sho 63-92965, in which a transparent resin layer is formed on a recording medium; toner is transferred to the recording medium; and then a roll type heat fixing unit is operated so that the toner is embedded in the transparent resin layer. According to this method, the roughness of the image can somewhat be prevented. An influence of application of silicon oil as a releasing agent to the fixing heat roll as has been performed with the conventional method results in formation of a silicon oil film having a low surface tension between the toner and the transparent resin. As a result, the toner cannot sufficiently be embedded in the transparent resin layer and the toner image portion projects upwards over the surface of the recording medium.

In, for example, the Unexamined Japanese Patent Application Publication No. Hei 5-216322, a method having a similar object has been suggested in which toner is electrostatically transferred to a recording medium having, on the surface thereof, a transparent resin layer composed of thermoplastic resin having a thickness of 20 $\mu$m to 200 $\mu$m; and then a belt-type fixing unit is operated so that the toner is embedded in the transparent resin layer. Since the belt-type fixing unit is able to separate toner from the belt after the toner has been fixed to the recording medium, the autoagglutination force of the toner can be used as the force for preventing adhesion to the belt. As a result, any releasing agent is not required and sufficiently long heating time can be permitted. Therefore, surface roughness can be moderated. However, the disclosed types of the toner resin and the thermoplastic resin in the surface layer cannot attain satisfactory compatibility between the molten toner resin and the thermoplastic resin in the surface layer of the recording medium. As a result, a fact was found that difference in the refractivity arose at the interface in the coated surface layer, thus causing the color reproducibility to deteriorate and somewhat irregular surface to remain.

Each of the disclosed image forming methods, having the step of electrostatically transferring a toner image to a recording medium and using the thermoplastic resin formed on the surface of the recording medium and having a low dielectric constant, suffers from problems of color irregularity and narrowing of the color producible region because the transfer rate of a color, which is finally transferred, is reduced when, for example, color toners are transferred in a multiple manner.

To solve the problem which arises when an image is transferred because of deterioration in the dielectric constant, in the Unexamined Japanese Patent Application Publication No. Hei. 5-273781, a recording method has been suggested which has a structure that inorganic oxide particles are dispersed and contained in thermoplastic transparent resin so that the dielectric constant is raised. However, paper employed as the base of a recording medium has a non-uniform structure in general from a microscopic viewpoint. Therefore, disorder of the electric field occurring attributable to electrical irregularity of the recording medium when the transference is performed cannot easily be prevented. Thus, there arises a problem in that color irregularity is generated and the graininess deteriorates.

SUMMARY OF THE INVENTION

In view of the foregoing, an object of the present invention is to provide an image forming method, an image forming apparatus adaptable to the method and a recording medium for use in the method and the apparatus each of which is capable of realizing glossiness of an image, which is the same as that of the recording medium, and excellent color reproducibility, preventing color irregularity, having excellent graininess, free from irregular glossiness occurring in a small region having a diameter of 1 mm to 3 mm and exhibiting excellent uniformity of glossiness of the formed image.

Inventors of the present invention has paid attention to the correlative relationship between the physical properties of a transparent resin layer on the surface of a recording medium and toner resin for use in toner, and thus found a fact that employment of a method of smoothly transferring toner to the recording medium and adjustment of the softening points of the transparent resin material for use in the recording medium and the toner was able to achieve the above-mentioned objects of the present invention.

That is, an image forming method according to the present invention and arranged in such a way that a toner image carried to a transferring position by a toner image holding member for holding and carrying the toner image from a toner image forming position to the toner image transferring position is transferred to a predetermined recording medium, the image forming method comprises: a transferring and fixing step of bringing the carried toner image into close contact with the recording medium and transferring and fixing the toner image while heating the toner image, wherein a recording medium is employed as the recording medium which has a thermoplastic transparent resin layer on at least a surface of a base thereof on which the toner image is transferred and softening point (Tmp) of the transparent resin is in the range from −1° C. to 30° C. from softening point (Tmt) of the toner.

When the softening point (Tmp) of the transparent resin of the thermoplastic transparent resin and the softening point (Tmt) of the toner of the toner satisfy the above-mentioned range, the compatibility of the two elements at predetermined temperatures can be improved. Thus, a toner image can smoothly be embedded in the transparent resin layer on the surface of the recording medium. As a result, a flat image free from irregular surfaces formed attributable to adhesion of the toner can be formed.

It is preferable that the above-mentioned image forming method further comprises the step of preheating the toner image held by the toner image holding member in such a manner that the temperature of the surface of the toner image is higher than a softening point (Tmt) of the toner before the toner image is carried to the toner image transferring position.

It is preferable that the above-mentioned image forming method further comprises the step of separating the recording medium from the toner image holding member at a position downstream of the toner image transferring position after the surface temperature of the transparent resin layer of the recording medium has been made to be lower than the softening point (Tmp) of the transparent resin by 10° C. or more.

It is further preferable that the image forming method uses the recording medium having an angle of contact of 40° or smaller between a resin material forming the transparent resin layer and the toner which is in a molten state.

It is further preferable that the image forming method has a structure that weight average molecular weight (Mw) of a resin material forming the transparent resin layer is in the range from 5,000 to 60,000, number average molecular weight (Mn) of the same is in the range from 2,000 to 5,000 and Mw/Mn is in the range from 2 to 15.

It is further preferable that a resin material forming the transparent resin layer is employed which contains polyester resin type component units.

An image forming apparatus according to the present invention comprises: means for forming a toner image; a toner image holding member for holding and carrying the formed toner image from a predetermined toner image forming position to a predetermined toner image transferring position; and transferring and fixing means for transferring the toner image carried to the toner image transferring position to a predetermined recording medium, wherein at least either the toner image holding member or the transferring and fixing means is, at the toner image transferring position, provided with heating and pressing means for, by using heat energy, transferring and fixing the toner image to a transparent resin layer of the recording medium having a thermoplastic transparent resin layer on at least a surface of a base on which the toner image is transferred, the transparent resin layer containing transparent resin having a softening point (Tmp) in the range from −1° C. to −30° C. from softening point (Tmt) of the toner.

An image forming apparatus according to another aspect of the present invention comprises: means for forming a toner image; a toner image holding member for holding and carrying the formed toner image from a predetermined toner image forming position to a predetermined toner image transferring position; and transferring and fixing means for transferring the toner image carried to the toner image transferring position to a predetermined recording medium, wherein at least either the toner image holding member or the transferring and fixing means is, at the toner image transferring position, provided with heating and pressing means for transferring and fixing the toner image, and heating means for heating the surface temperature of the toner image held on the toner image holding member to be higher than the softening point (Tmt) of the toner before the toner image reaches the toner image transferring portion.

It is preferable that each of the image forming apparatuses has a structure that cooling means for cooling the surface temperature of transparent resin of the recording medium to be lower than the softening point (Tmp) of the transparent resin by 10° C. or more is provided downstream of the toner image transferring position and upstream of a position at which the recording medium is separated from the toner image holding member.

A recording medium for use in the above-mentioned image forming method comprises a thermoplastic transparent resin layer on at least a surface of a base on which an image is recorded, wherein the softening point (Tmp) of a resin material forming the transparent resin layer is in the range from −1° C. to −30° C. from the softening point (Tmt) of toner for use to form a toner image which is recorded.

The preferred resin material for the transparent resin layer has a similar structure to that for use in the above-mentioned image forming method. It is preferable that the recording medium has the base made of a non-transparent material, a white pigment layer is provided on the surface of the base and the transparent resin layer is provided on the surface of the white pigment layer.

DETAILED DESCRIPTION OF THE PREFERRED EMBODIMENTS

Figure 1:
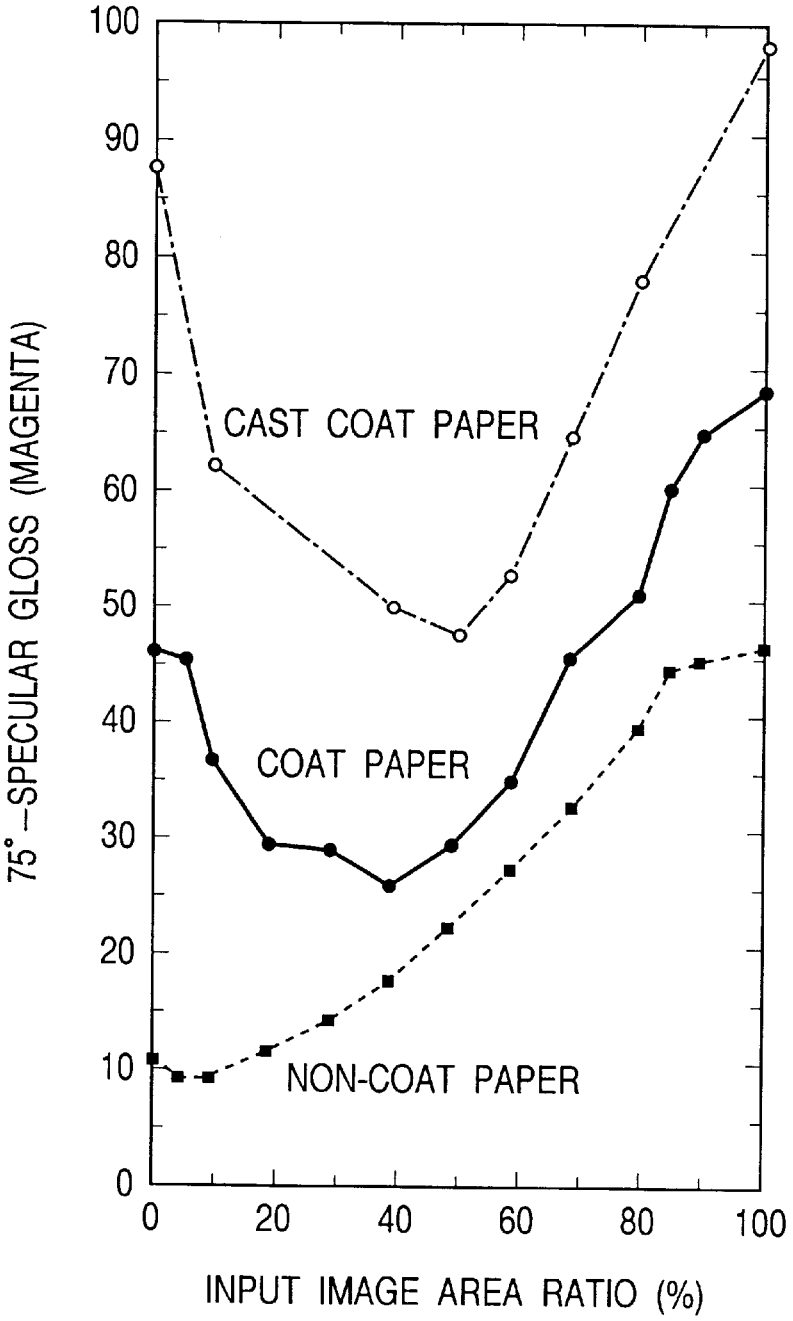
FIG. 1 is a graph showing results of measurement of 75-degree specular glossiness of images formed on various bases after the input image area ratio has been varied.
Figure 2:
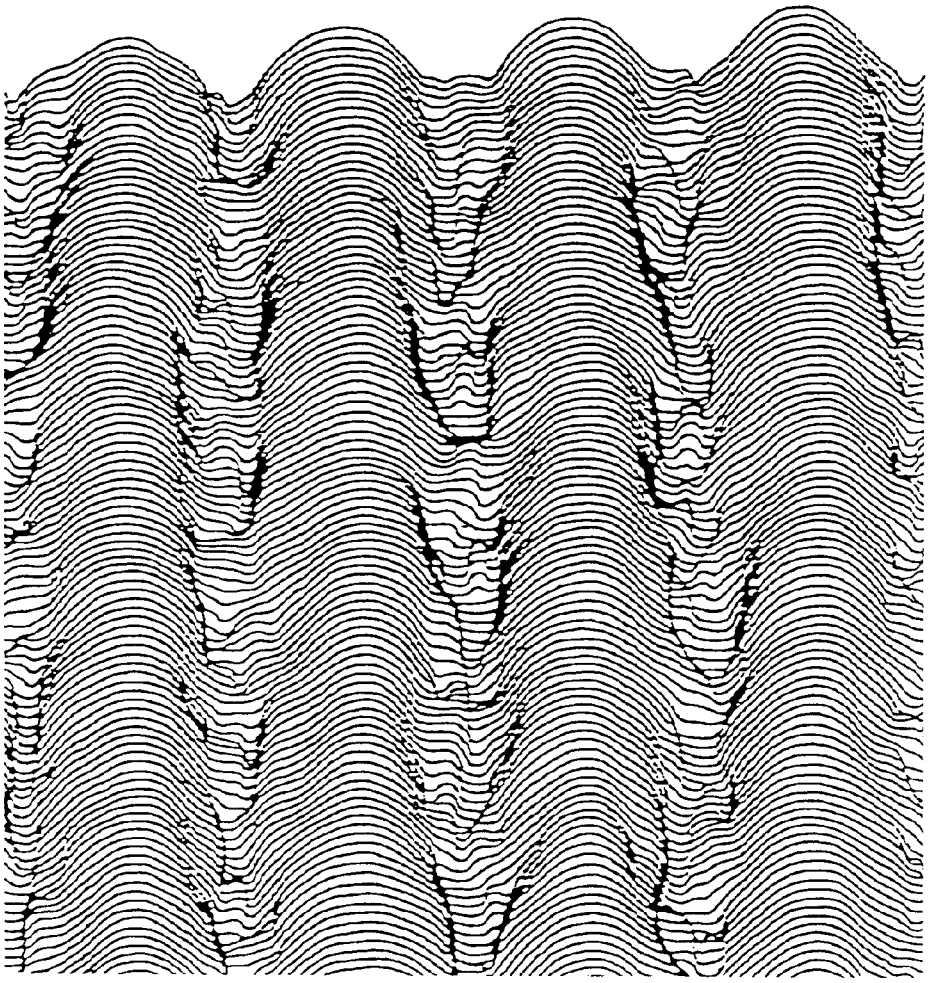
FIG. 2 shows an image profile of a 40% image area ratio portion of a toner image formed on cast coat paper obtained by a 3D surface roughness meter.
Figure 2:
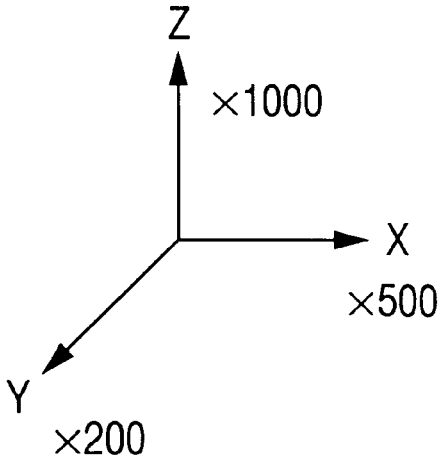

The image forming method according to the present invention and an image forming apparatus suitable for the method will now be described in accordance with the flow of the electrophotographic method.

A digital electrophotographic method has been widely employed in printers and copying machines as a method capable of quickly providing a high quality image. In this method, a light beam adjusted by an image forming optical system to form a spot having a predetermined diameter is used so that a photosensitive medium is scanned with the light beam. The period of time for which the light beam is applied is controlled in response to an image density is determined by a pulse width modulation means so that a latent image having an area modulated to correspond to the image density signal is formed on the photosensitive medium. The latent image is visualized by toner so that an image is formed.

The image forming process for forming a toner image is not limited to the above-mentioned electrophotographic method. For example, a process may be employed in which toner is allowed to directly fly to the surface of predetermined toner image holding member in accordance with digital-processed image data so that a toner image is formed on the toner image holding member. The image forming process may be structured such that a magnetic latent image is formed on a predetermined toner image holding member in accordance with digital-processed image data and a toner image is formed on the toner image holding member in accordance with the magnetic latent image. The image forming process may be structured such that a charge image is formed directly on a predetermined toner image holding member in accordance with digital-processed image data so that an electrostatic latent image is formed; and then a toner image is formed on the toner image holding member in accordance with the electrostatic latent image.

When a color image is formed, exposing conditions and developing conditions are determined in such a manner that the quantity of toner in each color is made to be 0.4 mg/cm$^2$ to 0.7 mg/cm$^2$ in general though the quantity varies depending upon the content of the corresponding pigment.

The toner image formed on the toner image holding member may be carried together with the movable toner image holding member or may be primarily transferred to an intermediate transferring medium, and then carried to a position at which it is transferred to the recording medium so that transference and fixing are performed simultaneously. In the latter case, the intermediate transferring member is the toner image holding member according to the present invention.

A method adapted to the electrophotographic method will now be described which has the steps of electrostatically transferring a toner image to the toner image holding member (hereinafter called the "image holding member" or the "intermediate transferring member" correspond to the structure); and simultaneously transferring and fixing the toner image to a recording medium.

The intermediate transferring member is, like paper which is a usual recording medium, not easily affected by the environment (temperature and humidity) and physically stable because of a stable surface characteristic and resistance value. Therefore, the intermediate transferring member can be used in an electrostatic transferring operation in a close contact manner. If proper physical property values are provided, the above-mentioned disorder and irregularity of the toner image occurring attributable to disorder of the transferring electric field can substantially be prevented. Important factors, required for the intermediate transferring member when the electrostatic transferring operation is performed, are surface resistivity Rs (Ω/square) and volume resistivity Rv (Ω·cm). It is preferable that Rs satisfies $10^8<Rs<10^{16}$. It is preferable that Rv satisfies $10^7<Rv<10^{15}$. If Rs and Rv are smaller than the above-mentioned ranges, electric charges are dispersed excessively. If they are larger than the above-mentioned ranges, electric charges are gathered excessively.

The toner image electrostatically transferred to the surface of the intermediate transferring member is composed of halftone dots and multiline structures which are pixels in the form of aggregation of the toner. In accordance with the area ratio, a required density of the image is obtained. The toner image is transferred and fixed to a recording medium at the transferring and fixing position. Therefore, the toner images are not directly and electrostatically transferred to a recording medium in the multiplex manner. As a result, the above-mentioned disorder of an image can be prevented and a clear image free from irregular transference can be formed on the image holding member.

In the transferring and fixing portion, the intermediate transferring member, which is the image holding member, the toner image and the recording medium are integrally pressed and heated so that powder toner is brought to a molten state and toner particles are fused. As a result, one flat film is formed. In order to efficiently transmit heat to the toner image and to cause the molten toner to sink into the recording medium so as to form a flat image, the intermediate transferring member and the recording medium must be brought into closely contact with each other. If close contact cannot be realized and thus air is undesirably partially introduced, the thermal capacity is changed between portions containing air and portions containing no air. As a result, the toner image cannot uniformly be fused and irregular transference and fixation result in fine irregular gloss portions having diameters of several millimeters being generated.

To cause the molten toner to sink into the recording medium and to smooth the surface as described above, and to prevent fine irregular gloss, the image forming method according to the present invention must be provided with a thermoplastic transparent resin layer on the surface of the employed recording medium. As a result of investment performed by the inventor of the present invention, the thermoplastic resin which is provided for the surface of the recording medium and which has softening point (Tmp) similar to or lower than the softening point (Tmt) of the toner has a greater effect of allowing toner to sink even if the toner is heated to the same temperature as that of the thermoplastic resin on the surface of the recording medium. Since the adhesive strength of the recording medium to the image holding member is enlarged in this case, a satisfactory effect can be obtained because fine irregular gloss can be prevented. That is, it is preferable that the thermoplastic resin, which is formed on the surface of the recording medium, has the softening point (Tmp) satisfying a relationship with the softening point (Tmt) of the toner such that a range from −1° C. to −30° C.[Tmt −30(°C.)≦Tmp(°C.)≦Tmt+10(°C.)] is satisfied. More preferably, the thermoplastic resin, which is provided on the surface of the recording medium, has the softening point (Tmp) satisfying a relationship with the softening point (Tmt) of the toner such that −1° C. to −20° C.[Tmt−20(°C.)≦Tmp(°C.)≦Tmt(°C.)] is satisfied. If the softening point (Tmp) of the thermoplastic resin which is provided on the surface of the recording medium is higher than the softening point (Tmt) of the toner, molten toner cannot satisfactorily be allowed to sink in the transparent resin layer on the surface of the recording medium. If the thermoplastic resin having the softening point (Tmp) lower than the softening point (Tmt) of the toner by 30° C. or more is used, the molten toner excessively disperse in the surface layer of the recording medium. As a result, the sharpness and graininess of the image deteriorate. Moreover, the melt viscosity of the resin in the surface layer of the recording medium is lowered excessively, thus resulting in defective separation from the toner image holding member.

The softening point (Tmt) of the toner and the softening point (Tmp) of the resin material for forming the transparent resin layer formed on the surface of the recording medium are defined as follows.

Flow Tester CFT500C manufactured by Shimadzu Seisakusho Kabushiki Kaisha is used to measure a state of softening after the temperature has been raised at a constant rate under conditions that the initial temperature is 80° C. to 170° C., the rate at which the temperature is raised is 3° C./minute, time for which preheating is performed is 300 seconds, the pressure in the cylinder is 10 kgf/cm$^2$ and a die having size L×D=1.0 mm×1.0 mm is used. Since resin in the toner cannot solely be sampled, the toner is weighed to obtain toner samples. Samples of the transparent resin which is provided for the surface of the recording medium are in the form of fine powder obtained by precisely weighing the transparent resin in a quantity of 1 g to 3 g. The cross sectional area of the plunger is 10 cm$^2$.

The measurement is performed by a method with which the sample is gradually heated as the temperature is raised at the constant rate, and thus the sample starts flowing. When the temperature is further raised, the sample in the molten state considerably flows, and the downward movement of the plunger is interrupted. Thus, one measurement operation is ended. The amount of flow at each temperature of 60° C. to 150° C. is measured by 3° C. so that apparent viscosity η' (Pa·s) is obtained. At this time, the temperatures at each of which the apparent viscosity η' (Pa·s) is made to be $1\times10^4$ Pa·s are defined to be the softening point (Tmt) of the toner and the softening point (Tmp) of the transparent resin which is provided for the surface of the recording medium.

To improve the adhesiveness between the toner intermediate transferring member and the recording medium which face each other while interposing the toner image at the position at which the toner image is transferred, it is preferable that an elastic layer is formed on the surface of the intermediate transferring member. It is preferable that the hardness of the elastic layer is 10 degrees to 80 degrees in terms of the rubber hardness and the thickness of the same is 10 μm to 300 μm. If the rubber hardness of the elastic layer on the surface of the intermediate transferring member is lower than 10 degrees, the intermediate transferring member is worn quickly. Thus, a required gloss cannot be obtained with the formed image. If the hardness is greater than 80 degrees, the toner cannot easily be enclosed. Thus, fine irregularity of gloss easily takes place. If the thickness of the elastic layer is smaller than 10 μm, the toner cannot easily be enclosed. Therefore, fine irregular gloss easily takes place. If the thickness is larger than 300 μm, great electric power is required to perform effective heating in the transferring and fixing portion. Thus, a satisfactory result cannot be obtained in either case.

In general, the transferring and fixing portion comprises a heating roll including a heat source, such as a halogen lamp, and a pressing roll for pressing the intermediate transferring member, the toner image and the recording medium with the heating roll. It is preferable that the pressure at the nipping position is $1\times10^3$ Pa to $1\times10^6$ Pa. If the pressure is lower than the above-mentioned range, the intermediate transferring member, the toner image and the recording medium cannot sufficiently be pressed. Thus, the molten toner cannot satisfactorily penetrate the recording medium, and fine irregular gloss easily takes place. If the pressure is higher than the range, the stress on the intermediate transferring member and the recording medium is intensified excessively. Thus, creases are generated or the mechanism and apparatus for bearing the high pressure become complicated excessively. As an alternative to the heating roll, a fixed heating member may be employed which has an electric heater provided on a heat-resisting support member thereof and a heat and wear resisting layer covering the surface thereof.

Figure 3:
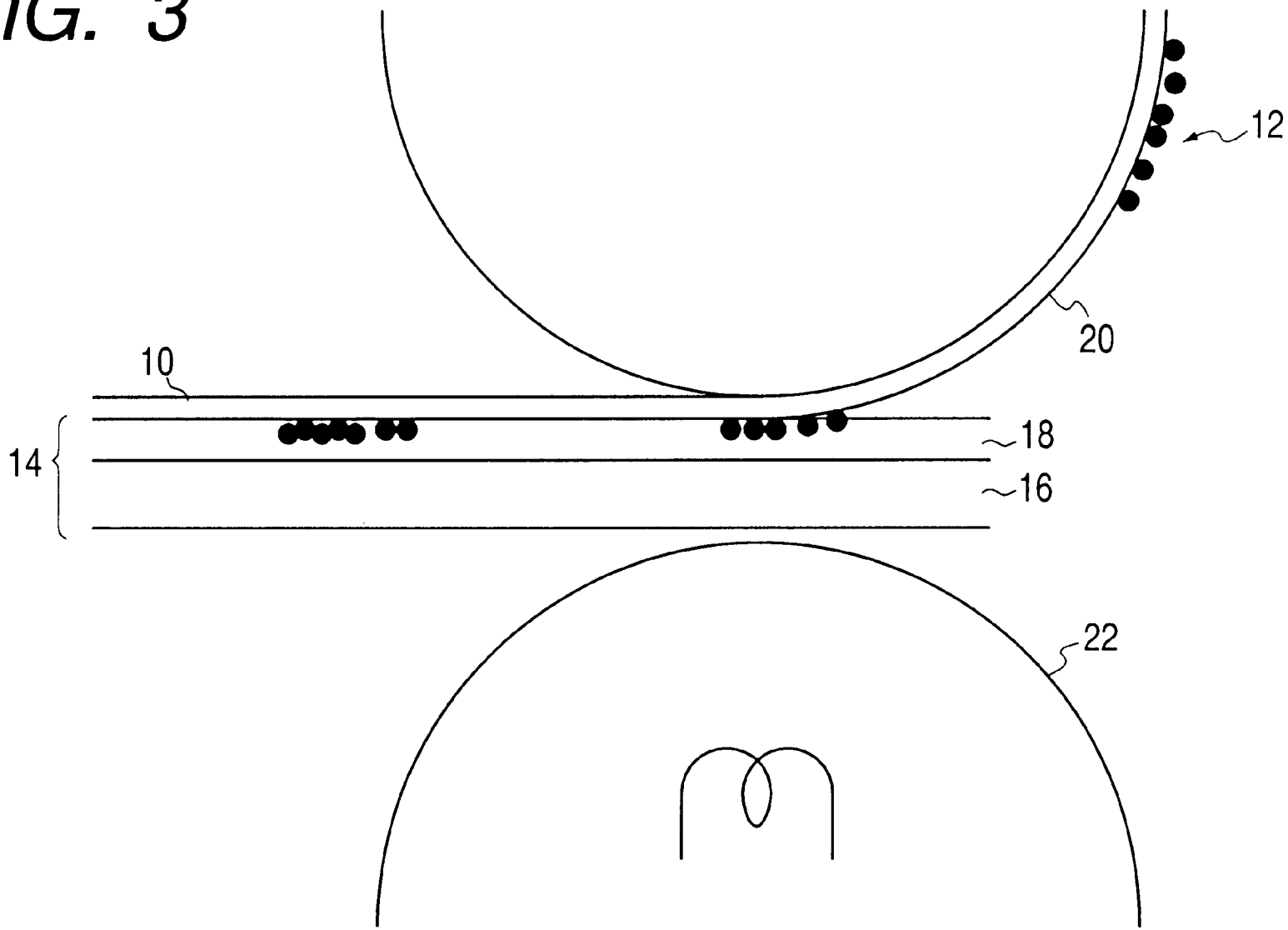
FIG. 3 is a schematic view showing the operation of a toner image at a transferring and fixing position realized when the image forming method according to the present invention is employed.

FIG. 3 is a schematic view showing the operation of the toner image at the transferring and fixing position which is performed with the image forming method according to the present invention. A toner image 12 formed on the surface of a toner image holding member (an intermediate transferring member) 10 and arranged to be carried is brought into close contact with a recording medium 14 at the transferring and fixing position. The recording medium 14 has a structure in which a transparent resin layer 18 is formed on a base 16 thereof. The toner image 12 is, by a pressing roll 20 and a heating roll 22, heated and brought into close contact with the transparent resin layer 18 on the surface of the recording medium 14 and transferred to the same. Since the softening point (Tmp) of the transparent resin layer 18 on the surface of the recording medium 14 is in the range from −1° C. to −30° C. from the softening point (Tmt) of the toner, the toner image 12 is fused in the region in which the recording medium 14, the toner image 12 and the image holding member 10 are in close contact with one another and thus allowed to sink into the transparent resin layer 18 formed on the surface of the recording medium 14. As a result, the transferred image has excellent color and exhibits smooth surface and satisfactory glossiness. Some heating and pressing conditions cause the viscosity of the resin material for forming the transparent resin layer 18 on the surface of the recording medium 14 before the melt viscosity of the toner image 12 is lowered. As a result, the toner is allowed to sink in the transparent resin layer 18 in a state where the toner has the elasticity. Thus, the toner slightly projects after the pressure has been released or the toner cannot sufficiently be melted in the transparent resin layer 18. In this case, color development and glossiness become unsatisfactory. Therefore, it is preferable that the transferring and fixing conditions are controlled in such a manner that the time for which the recording medium 14, the toner image 12 and the image holding member 10 are in close contact with each other is elongated sufficiently or the heating temperature is raised.

Moreover, the inventors or the present invention found a fact that a structure for heating the surface which was in contact with the toner image 12 on the image holding member 10 at a position upstream of the transferring and fixing position which is the image holding member to preheat the toner image 12 enables an excellent transferred image to be formed without a necessity of performing a complicated adjustment of the transferring and fixing conditions and that the preferred preheating temperature is higher than the softening point (Tmt) of the toner.

Figure 4:
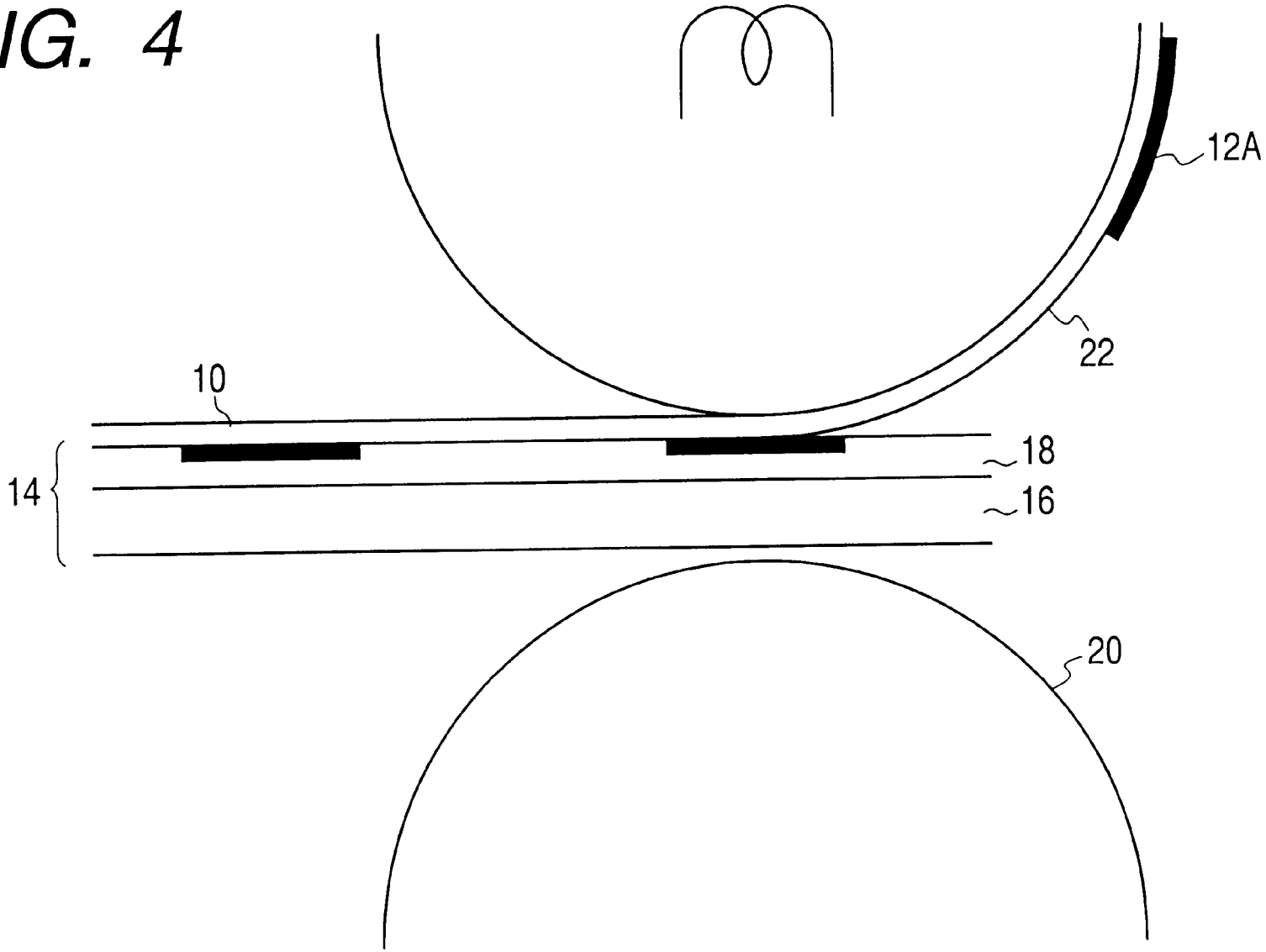
FIG. 4 is a schematic view showing the operation at the transferring and fixing position when a toner image is preferably preheated with the image forming method according to the present invention.

FIG. 4 is a schematic view showing the operation which is performed at the transferring and fixing position in the preferred case where the toner image has been preheated with the image forming method according to the present invention. The toner image on the surface of the toner image holding member (the intermediate transferring member) 10 is previously heated at a position upstream of the transferring and fixing position to a level near the softening point (Tmt) of the toner so that the toner image is formed into a toner image 12A in a molten state. That is, the toner previously brought to a low viscosity state is introduced into a nip region in which the recording medium 14, the toner image 12A and the image holding member 10 have been brought into close contact with one another.

The toner image 12A is, by the pressing roll 20 and the heating roll 22, heated, brought into close contact with the transparent resin layer 18 on the surface of the recording medium 14 and transferred to the same. At this time, the softening point (Tmp) of the transparent resin layer 18 on the surface of the recording medium 14 satisfies the range from +10° C. to −30° C. from the softening point (Tmt) of the toner. Moreover, the transparent resin layer on the surface of the recording medium 14 can be melted and the toner image 12 in the molten state can be allowed to sink in the surface layer. In addition, the storage elastic modulus has been lowered. Therefore, undesirable projection of the image portion over the surface resin layer of the recording medium after the pressure has been released can be prevented. Moreover, the fact that the toner cannot sufficiently be melted in the resin layer on the surface of the recording medium can be prevented. As a result, an image having an excellent glossiness and color developing characteristic can be formed.

As the means for previously heating the intermediate transferring member, which is the image holding member, and the toner image, a structure may be employed in which the intermediate transferring member and the toner image are, as shown in FIG. 4, carried in such a manner that they are brought into close contact with the heating means, such as the heating roll, secured at the transferring and fixing position to transfer the toner image at a position upstream of the transferring position for predetermined time. Any special heating means is not required. By using the heating means for transparent and fixing the toner image, the preheating process can be performed. A heating (preheating) means, such as a heating lamp or a heating roll, including a heat source may be disposed upstream of the transferring and fixing position individually from the heating member secured at the transferring and fixing position and arranged to transfer the toner image. The heating means is not limited to the above-mentioned description. Any known means may be employed if it is able to heat the toner image to a required temperature level.

The recording medium, to which the toner has been transferred, and the intermediate transferring member, which is the image holding member, are carried in a close contact state, and then separated from each other at the separating position. It is preferable that the recording medium is separated from the image holding member when the surface temperature of the recording medium which is in contact with the image holding member is lower than the softening point (Tmp) of the transparent resin layer formed on the surface of the recording medium by 10° C. or more.

Figure 5:
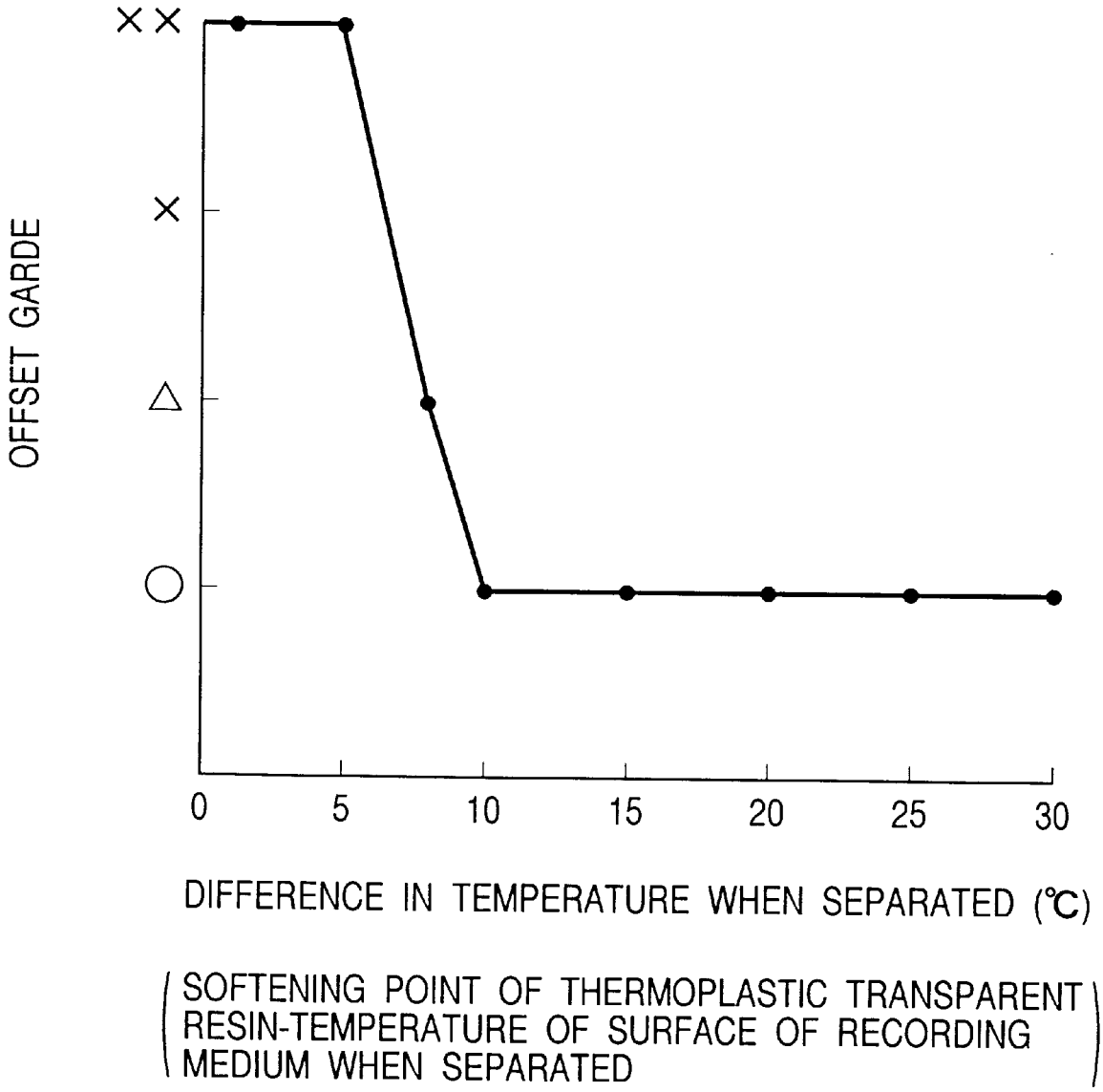
FIG. 5 is a graph showing the relationship among softening point (Tmp) of transparent resin, the difference in the temperature of the recording medium at a separating position and of set grade of the surface of the separated recording medium.

FIG. 5 is a graph showing the relationship between the difference between the temperature of the recording medium at the softening point (Tmp) of the transparent resin and the temperature of the same at the separating position and the offset grade of the surface of the recording medium separated at the separating position. The offset grade was evaluated in accordance with the following criteria.

Offset Grade ××: excessive separation of the transparent resin layer

×: rough surface of the recording medium

Δ: slight roughness of the surface of the recording medium

○: no problem arises

As can be understood from FIG. 5, the separated recording medium on which an image has been formed has a satisfactory surface state if the temperature of the surface of the separated recording medium is different from the softening point (Tmp) of the transparent resin formed on the surface of the recording medium by 10° C. or smaller. The reason for this can be considered that if the recording medium is separated in a state where the transparent resin layer formed on the surface of the recording medium has not sufficiently large cohesive force, that is, in a state where it is softened, an offset phenomenon is generated in which the transparent resin on the surface of the recording medium is shifted to the image holding member or the surface of the recording medium is roughened when the separation is performed and thus glossiness of the formed image deteriorates.

The temperature of the surface of the recording medium can be measured by previously disposing a thermocouple on the surface of the recording medium and by monitoring the temperature until the recording medium is separated from the image holding member after the image holding member and the toner have been subjected to the transferring and fixing process.

The cooling means for lowering the surface temperature of the recording medium is not always required. For example, a method of elongating the distance from the transferring and fixing position to the separating position or a method of lowering the atmospheric temperature is able to realize a preferred state of separation. If the cooling means is disposed downstream of the transferring and fixing position and upstream of the separating position, an image having a preferred surface condition can efficiently be formed.

Figure 6:
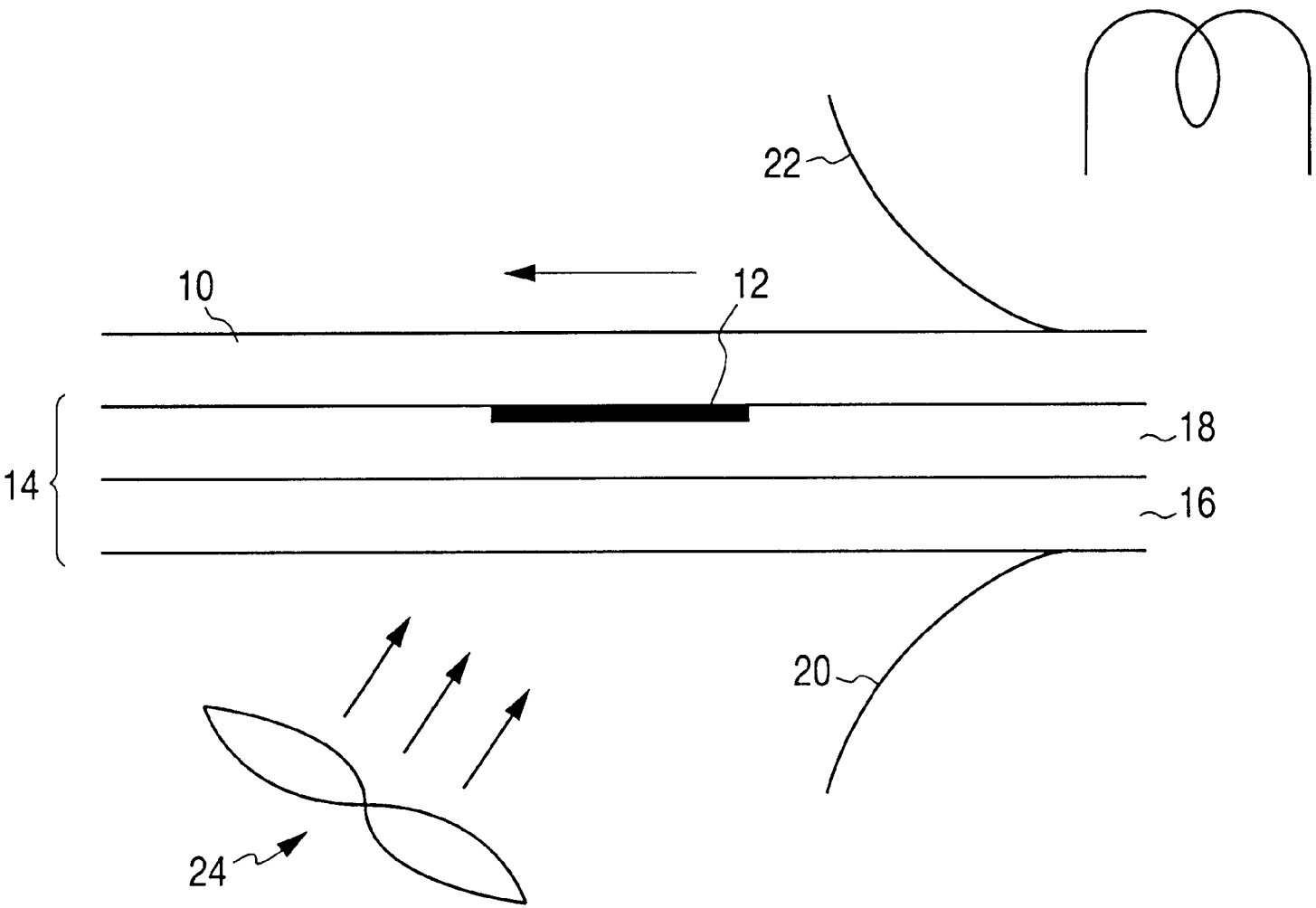
FIG. 6 is a schematic view showing a state where an intermediate transferring member, a toner image and a recording medium, which are moved while being in close contact with one another, are cooled by a cooling fan disposed downstream of the transferring and fixing position.
Figure 7:
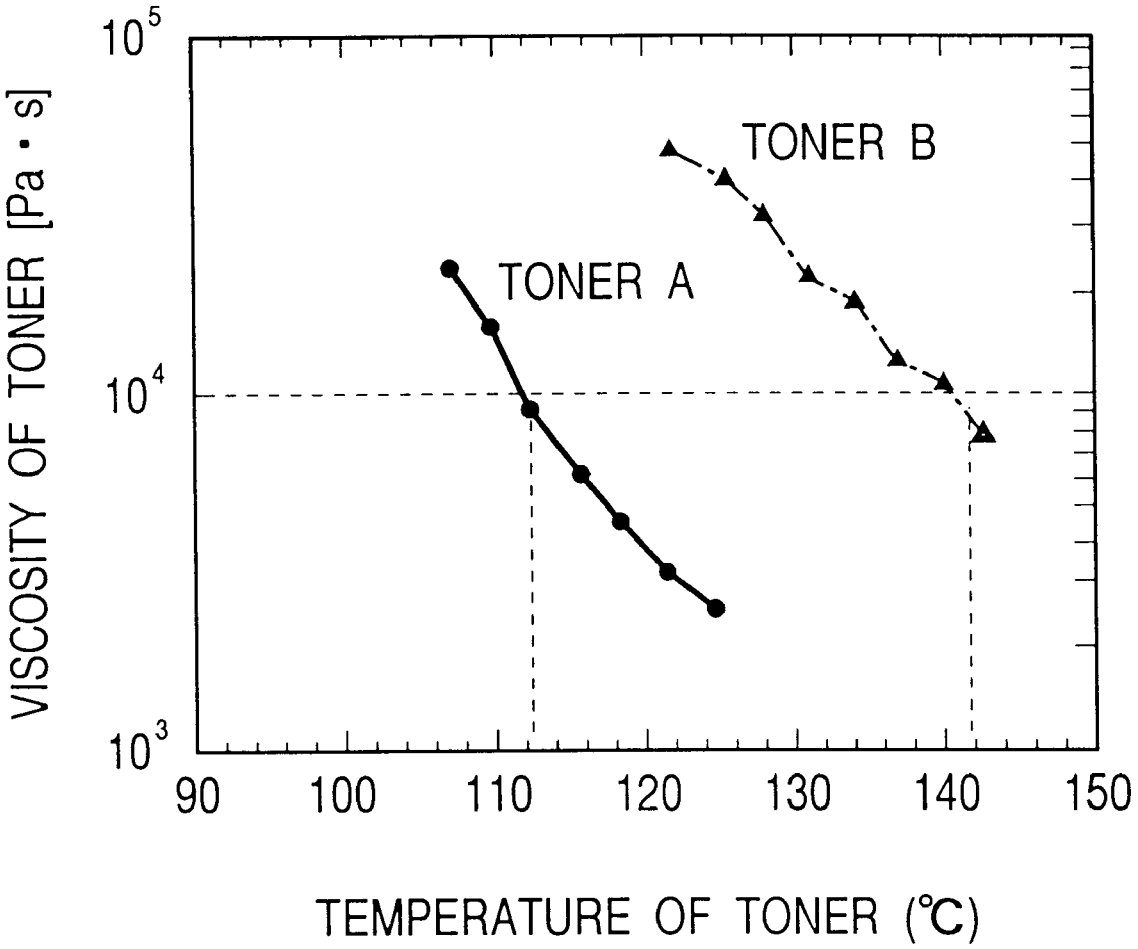
FIG. 7 is a graph showing temperature/viscosity characteristics of the toner according to the present invention.

FIG. 6 is a schematic view showing a state where a cooling fan 24 is disposed downstream of the transferring and fixing position to which the image holding member 10, the toner image 12 and recording medium 14 are carried in a state where they are close contact with one another so as to cool the surface.

As the cooling means, a method in which the cooling fan 24 is disposed or a method in which a member having a low temperature similar to the room temperature is, as the cooling means, brought into contact with the intermediate transferring member or the recording medium to shift heat from hot portion to a cold portion may be employed. Thus, the above-mentioned efficient cooling effect can be obtained. In the latter case, the cooling means arranged to be brought into contact with the recording medium is formed into a belt shape to be capable of circulating. Moreover, a portion of the upper surface of the belt is brought into contact with the intermediate transferring member or the recording medium at the outlet portion of the heating and pressing nip. Then, the belt is cooled at a position different from the cooling position so as to be used again. Thus, the cooling effect can continuously be obtained. As described above, the cooling medium, such as the belt which is the cooling means, is subjected heat exchange with another cold member at a position different from the position at which the intermediate transferring member or the recording medium is cooled downstream of the outlet portion of the heating and pressing nip. Thus, efficient cooling can be performed without influence on the temperature in the image forming apparatus. The heat exchange with the cold member may be performed for example, by bringing the belt with the cold intermediate transferring member before it reaches the heating and pressing region.

As the cooling means which is disposed at the outlet portion of the heating and pressing nip, heat may be transferred by using a heat exchanging unit, for example, a heat pipe.

Although the means for cooling the outlet portion of the heating and pressing nip may be provided for either of the heating member portion or the pressing member portion or both of the same, undesirable rise in the temperature of the cooling means can be prevented if it is provided adjacent to the pressuring member portion having a relatively low temperature.

Moreover, the quantity of heat to be derived from the heating member can be reduced. Thus, transferring and fixing can thermally efficiently be performed.

Binding resin for the toner for use in the present invention may be any known resin. For example, it is preferable to employ styrene, such as styrene, vinyl toluene, α-methyltoluene, chlorostyrene or aminostyrene, mono- or copolymer of its derivative or substitution product; mono- or copolymer of methacrylate, such as methacrylic acid, methylmethacrylate or ethylmethacrylate; mono- or copolymer of acrylic ester, such as acrylic acid, methyl acrylate, butyl acrylate or 2-ethylhexylacrylate; diene such as butadiene or isoprene; mono- or copolymer of vinyl monomer with another monomer, the vinyl monomer being acrylonitrile, vinyl ether, maleic anhydride, vinyl chloride or vinyl acetate; or polyamide; polyester or polyurethane or their mixture. It is preferable that a material including units of polyester materials be employed.

The polyester can be prepared by allowing polyhydric alcohol and polybasic carboxylic acid to react with each other. The polyhydric alcohol for forming the polyester is, for example, diol, such as ethylene glycol, diethylene glycol, triethylene glycol, 1, 2-propylene glycol, 1, 3-propylene glycol, 1, 4-butane diol, neopentyl glycol, 1, 4-butane diol, cyclohexanedimethanol; bisphenol A having alkylene oxide added thereto, such as hydrogenated bisphenol-A, polyoxypropylene bisphenol-A; and other bivalent alcohol.

The polybasic carboxylic acid may be maleic acid, fumaric acid, methaconic acid, citraconic acid, itaconic acid, terephthalic acid, isophthalic acid, cyclohexanedicarbonic acid, succinic acid, their acid anhydride, alkylester or the other dibasic carboxylic acid. However, the polybasic carboxylic acid is not limited to these materials.

A coloring matter which is mixed with the binding resin for the toner may be known pigment or dye. To control electrostatic charge, a known additive for toner may be employed.

The recording medium for use in the image forming method according to the present invention has the structure in which a thermoplastic transparent resin layer having a specific softening point is formed on the base. The material of the base is not limited and therefore a known material for the base of a recording medium may be employed. Specifically, acid or neutral woodfree paper, medium quality paper, groundwood paper, regenerated paper or synthetic paper may be employed. A filler for use in the base is not limited. For example, calcium carbonate, such as calcium carbonate heavy, calcium carbonate light or whiting; silicic acid, such as kaolin, baked clay, pyrophyllite, sericite or talc; inorganic filler, such as titanium dioxide; or organic pigment such as urea resin or styrene may be employed. The sizing material is not limited. A rosin type sizing material, synthetic sizing material, petroleum resin type sizing material or neutral sizing material may be employed. A proper sizing material, such as aluminum sulfate or cationic starch, and a fixing agent for the resin are combined with each other. Moreover, paper rigidity enhancer, dye and pH regulator may be added.

The base may be provided with a white pigment coated layer.

White pigment for use in the white pigment coating layer may be mineral pigment, such as calcium carbonate heavy, calcium carbonate light, titanium dioxide, aluminum hydroxide, satin white, talc, calcium sulfate, barium sulfate, zinc oxide, magnesium oxide, magnesium carbonate, amorphous silica, colloidal silica, white carbon, kaolin, baked kaolin, delaminate kaolin, aluminosilicate, sericite, bentonite or smecsite; polystyrene resin particles, urea formalin resin particles, fine hollow particles or other organic pigment or their combination. However, the white pigment is not limited to the above-mentioned materials. The white pigment may be bound by resin, such as water soluble adhesive agent, emulsion or latex or their mixture. For example, water soluble resin, such as polyvinyl alcohol, denatured polyvinyl alcohol, starch, gelatin, casein, methylcellulose, hydroxyethylcellulose, acrylic acid amide-acrylic ester copolymer or ternary copolymer of acrylic acid amide-acrylic acid-methacrylic acid; acrylic emulsion; vinyl acetate emulsion; vinylidene chloride emulsion; polyester emulsion; styrene-butadiene latex; or acrylnitrile-butadiene latex may be employed. However, it is not limited to the above-mentioned materials. If the above-mentioned white pigment and casein or the like are used and the coating surface is finished by a castoting method, a further smooth surface can be obtained. The white pigment coating layer may be added with dye or color pigment in a small quantity for adjusting the color tone and fluorescent dye for improving visual whiteness. Moreover, a variety of various auxiliaries, such as a dispersant, an anti-foaming agent, a plasticizing agent, pH regulator, lubricant, fluidity modifier, a solidification enhancer and waterproof agent and sizing agent may be added.

As an alternative to the above-mentioned paper type base, a heat resisting film material, for example, a polyethylene terephthalate film, a polysulfon film, a polyphenyleneoxide film, a polyimide film, a polycarbonate film or cellulose ester film may be employed which has a heat resisting temperature of 100° C. or higher.

The recording medium according to the present invention has the structure that the thermoplastic transparent resin layer for transferring and fixing molten toner and causing the molten toner to penetrate into the surface layer of the recording medium is provided for at least the surface of the base or a sheet formed by providing the white pigment layer for the base on which the toner image is transferred. The thermoplastic transparent resin for forming the resin layer may be mono- or copolymer of styrene, for example, styrene, vinyl toluene, α-methyltoluene, chlorostyrene and aminostyrene, its derivative or substitution product; mono- or copolymer of methacrylate, such as methacrylic acid, methylmethacrylate or ethylmethacrylate; mono- or copolymer of acrylic ester, such as acrylic acid, methylacrylate, butylacrylate or 2-ethylhexylacrylate; diene, such as butadiene or isoprene; mono- or copolymer of vinyl monomer, such as acrylonitrile, vinyl ether, maleic anhydride, vinyl chloride or vinyl acetate with another monomer; polyamide; polyester; polyurethane or their mixture. It is preferable that resin containing polyester type units (hereinafter sometimes called "polyester resin") is employed. The polyester resin can be prepared by allowing polyhydric alcohol and polybasic carboxylic acid to react with each other. The polyhydric alcohol for forming the polyester is, for example, diol, such as ethylene glycol, diethylene glycol, triethylene glycol, 1, 2-propylene glycol, 1, 3-propylene glycol, 1, 4-butane diol and cyclohexanedimethanol; bisphenol A having alkylene oxide added thereto, such as hydrogenated bisphenol-A, polyoxypropylene bisphenol-A; and other bivalent alcohol. The polyhydric alcohol is not limited to the above-mentioned materials. It is preferable that the bisphenol A having alkylene oxide added thereto, such as polyoxypropylene bisphenol-A is employed.

The polybasic carboxylic acid may be maleic acid, fumaric acid, methaconic acid, citraconic acid, itaconic acid, terephthalic acid, isophthalic acid, cyclohexanedicarbonic acid, succinic acid, their acid anhydride, alkylester, and the other dibasic carboxylic acid. However, the polybasic carboxylic acid is not limited to these materials.

To adjust the surface electric resistance of the above-mentioned transparent resin layer, the transparent resin layer may be added with one or more inorganic materials below: sodium chloride, potassium chloride, calcium chloride, sodium sulfate, zinc oxide, titanium dioxide, tin oxide, aluminum oxide and magnesium oxide. To control the friction coefficient of the recording medium, styrene type hard plastic particles may be added in a small quantity with which the quality of the image does not deteriorate.

It is preferable that the thickness of the thermoplastic transparent resin layer which is formed on the base is 2 μm to 20 μm, more preferably 4 μm to 15 μm. If the thickness is smaller than the above-mentioned range, the molten toner cannot sufficiently be embedded. Thus, an image which is not smooth and flat because of projections formed owning to the toner is formed. What is worse, satisfactory gloss cannot be realized. If the thickness is larger than the above-mentioned range, the sharpness of the image and color developing characteristic will deteriorate owning to the refractive index of the transparent resin layer. What is worse, larger energy is required to soften a thick resin layer.

The softening point (Tmp) of the polyester resin is made to be −1° C. to −30° C. from the softening point (Tmt) of the toner, preferably −1° C. to −20° C.

It is preferable that the weight average molecular weight (Mw) in 5,000 to 60,000, the number average molecular weight (Mn) is 2,000 to 5,000 and Mw/Mn is 2 to 15. If the molecular weight and the distribution of the molecular weight exceed the upper limit, the softening point of the thermoplastic transparent resin layer is raised and thus the toner cannot easily be embedded. If the values are lower than the lower limit, the thermoplastic transparent resin layer is excessively softened. As a result, the offset phenomenon sometimes undesirably takes place.

The molecular weight of the thermoplastic transparent resin was measured by gel permeation chromatography. That is, a full automatic hot and quick chromatograph (Waters ALS/GPC 150C manufactured by Waters) was employed as the measuring apparatus. As the solvent, tetrahydrofuran was used. The conditions were such that the flow rate was 1.0 ml/minutes, the temperature was 40° C. and a testing device was a differential refractometer (RI).

Scatter of light occurring at the interface between the transparent resin layer formed on the surface of the recording medium and the molten toner and the state of swell of the molten toner over the surface of the transparent resin of the recording medium also relate to the compatibility between the molten toner and the transparent resin layer. When resins having excellent compatibility are employed, a further flat and smooth image having uniform gloss can be formed. As the criterion for the compatibility of the resins, an angle of contact between the molten toner and the transparent resin layer is employed in the present invention. If the angle of contact is 40 degrees or smaller, the compatibility is evaluated to be satisfactory. The angle of contact is measured by the following method.

(1) Powder toner is enclosed in a tablet frame in the form of a tray shape having a diameter of 13 mm and a height of 33 mm for a tablet machine called Hand Press SSP-10 manufactured by Simadzu Seisakusho Kabushiki Kaisha. A load of 1 ton is applied by the hand press for one minute so that a toner disc is molded. A standard size of discs is such that the diameter is 13 m, thickness is 1.2 mm and the weight is 0.18 g.

(2) The recording medium is placed on a hot plate in such a manner that the base of the recording medium is in contact with the surface of the hot plate. Moreover, the toner disc is placed to be in contact with the transparent resin layer of the recording medium and the toner disc is allowed to stand at a predetermined temperature for 90 seconds. Then, the recording medium and the toner disc are placed on an aluminum plate which has been allowed to stand in an atmosphere, the temperature of which is 23°, in such a manner that the recording medium is in contact with the surface of the aluminum plate. Then, the temperature is lowered rapidly. At this time, the above-mentioned predetermine temperature is made to be lower than the softening point (Tmt) of the toner by 1° C.

(3) A contact-angle measuring apparatus manufactured by Kyowa Kaimen Kagaku Kabushiki Kaisha is used to measure four points (rotated by 90° at each measuring operation) of the skirt of the solidified toner which is in contact with the transparent resin layer. The average value is employed as the contact angle of the toner.

It is preferable that the angle of contact between the transparent resin layer and the molten toner is 40 degrees or smaller, more preferably 30 degrees or smaller. If the angle is larger than the upper limit, the toner image sometimes swells over the surface layer of the recording medium separated from the intermediate transferring member after the transferring and fixing operation has been performed. In particular, the glossiness deteriorates in the halftone image region and the highlighted image region and the color development sometimes deteriorates.

As described above, the image forming method according to the present invention enables a toner image to be embedded in the transparent resin layer of the recording medium without generation of disorder of the image and irregularity of color. Therefore, uniform glossiness can be realized in the overall image area ratio region. Thus, a color image having excellent graininess and free from irregularity of a color can be formed.

Use of the recording medium which can be used with the above-mentioned image forming method having the above-mentioned structure enables the effect of the image forming method according to the present invention to be obtained.

[EXAMPLES]

Examples of the present invention will now be described. Note that the present invention is not limited to the following examples.

[Manufacturing Recording Medium 1]

Enamel coat paper (Yonago Kakoshi Kabushiki Kaisha) which was commercial cast coat paper and which had basic weight of 127.9 g/m$^2$ was used as the base. Then, a transparent resin layer composed of 6 types of polyester resins having characteristics shown in the following Table 1 was formed on the surface of the base so that the recording medium was manufactured.

Six types (PE1, PE2, PE3, PE4, PE5 and PE6) of the polyester resins shown in the following Table 1 were prepared. Twenty parts by weight of each resin were mixed with 80 parts by weight of ethyl acetate, and then stirred until the resin was dissolved. The enamel coat paper (the base) was coated with each of the six types of obtained polyester solutions by using a Mayer bar in such a manner that the thickness of the resin layer dried sufficiently was 7 $\mu$m. The obtained recording mediums were given sample numbers P1, P2, P3, P4, P5 and P6.

Moreover, a transparent polyethylene terephthalate film having a thickness of 100 $\mu$m was used as the base, and then the base was coated with each of polyester resins PE1, PE3 and PE6 by a method similar to that employed when the paper base was coated in such a manner that the thickness was 3 $\mu$m. thus, three types of OHP films shown in Table 1 were obtained which were given sample numbers OHP1, OHP2 and OHP3. The thus-obtained recording mediums were used so that images were formed with the following toner and by the image forming apparatus.

Results of measurement of the softening point (Tmp), the weight average molecular weight (Mw) and the number average molecular weight (Mn) of each of the six types of polyester resins (PE1, PE2, PE3, PE4, PE5 and PE6) for forming the transparent resin layer and Mw/Mn were additionally shown in Table 1.

TABLE 1

| Recording Medium | Type of Polyester | Monomer Forming Thermoplastic Polyester | Tmp (° C.) | Mw | Mn | Mw/Mn |
|---|---|---|---|---|---|---|
| P1 | PE1 | BPA-EO, FMA | 89 | 13300 | 4000 | 3.3 |
| P2 | PE2 | BPA-EO, DSA, TPA | 90 | 12500 | 3900 | 3.2 |
| P3 | PE3 | BPA-EO, BPA-PO, TPA, glycerine | 100 | 12300 | 3270 | 3.8 |
| P4 | PE4 | BPA-EO, BPA-PO, derivative of succinic acid, TPA, TMA | 112 | 55000 | 4050 | 13.6 |
| P5 | PE5 | BPA-EO, BPS-PO, derivative of succinic acid, TPA, TMA | 129 | 72800 | 5100 | 5.9 |
| P5 | PE6 | BPA-EO, BPA-PO, TPA, TMA | 140 | 264000 | 5250 | 50.3 |
| OHP1 | PE1 | BPA-EO, FMA | 89 | 13300 | 4000 | 3.3 |
| OHP2 | PE3 | BPA-EO, BPA-PO, TPA, glycerine | 100 | 12300 | 3270 | 3.8 |
| OHP3 | PE6 | BPA-EO, BPA-PO, TPA, TMA | 140 | 264000 | 5250 | 50.3 |

BPA-EO: polyoxyethylene (2,2)-2,2-bis(4-hydroxyphenyl)propane
BPA-PO: polyoxypropylene (2,2)-2,2-bis(4-hydroxyphenyl)propane
TPA: terephthalic acid
FMA: fumaric acid
DSA: dodecenylsuccinic acid
TMA: trimellitic acid anhydride

[Manufacture of Toner]

Polyhydric alcohol and polyhydric carboxylic acid each having the composition as shown in the following Table 2 were introduced into a 1-litter four-neck and round bottom flask comprising a stainless steel stirrer, a glass tube for introducing nitrogen gas and a sulfur type condenser. Then, the flask was placed on a mantle heater. Then, nitrogen gas was introduced through the tube for introducing gas, and then the temperature was raised in a state where inert gas atmosphere was retained in the inside portion of the flask. Then, 0.05 of dibutyl tin oxide was added, and the temperature of the reactant was maintained at 200° C. Then, reactions were allowed to take place for predetermined time. As a result, polyester resins PE7 and PE8 were obtained.

Six parts by weight of yellow pigment were mixed with 10 parts by weight of the obtained polyester resin (PE7), and then melted and kneaded by an extruder. Then, the kneaded materials were cooled, and then pulverized by a jet mill. The pulverized powder was classified so that yellow toner having a volume average diameter of 7 $\mu$m was obtained. Similarly, each of 4.5 parts by weight of magenta pigment, 4.5 parts by weight of cyan pigment and 4 parts by weight of carbon black pigment were mixed with 100 parts by weight of polyester resin (PE7) so that magenta toner, cyan toner and black toner each having a volume average diameter of 7 μm were obtained. Then, the foregoing yellow toner was added so that toner set A in four colors was obtained (called "toner A").

Moreover, polyester resin (PE8) was used so that toner set B (called "toner B") was obtained by a similar method.

The average particle size of the toner was 7 μm.

TABLE 2

| Toner | Type of Polyester | Component Monomers | Tmt (° C.) |
|---|---|---|---|
| A | PE7 | BPA-EO, BPA-PO, derivative of succinic acid, TPA, DSA, TMA | 113 |
| B | PE8 | BPA-EO, BPA-PO, derivative of succinic acid, TPA, TMA | 142 |

[Image Recording 1]

Figure 8:
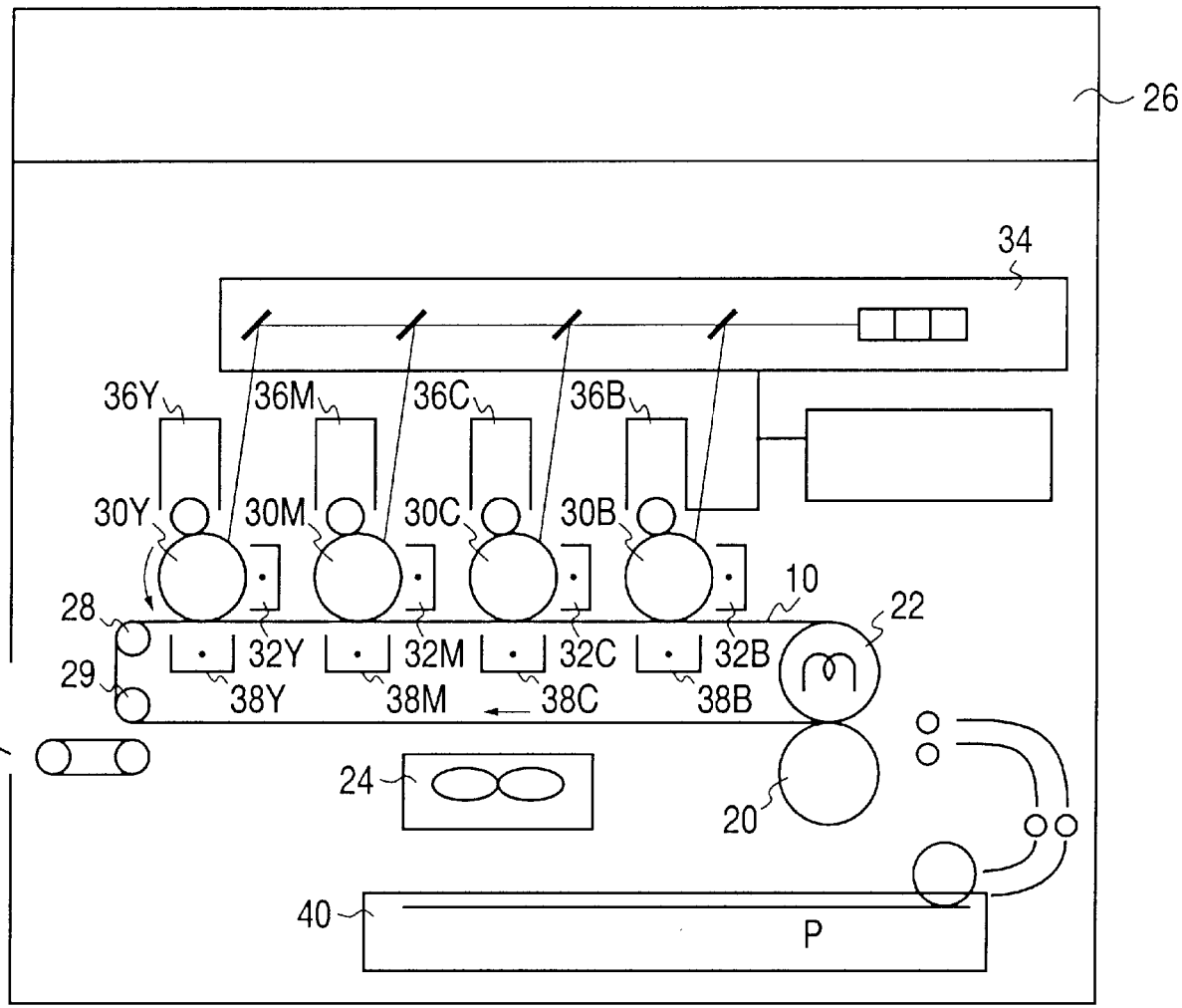
FIG. 8 is a diagram showing the structure of an image forming apparatus for use in [Image Formation 1] in the embodiment.

FIG. 8 is a diagram showing the structure of an image forming apparatus 26 adaptable to the image forming method according to the present invention.

In the image forming apparatus 26, a belt-type intermediate transferring member 10 is supported by rollers 28 and 29 and heating roll 22 so that the intermediate transferring member 10 is rotated in a direction indicated by an arrow shown in FIG. 8. A pressing roll 20 is disposed at the transferring and fixing position to face the heating roll 22. The heating roll 22 and the pressing roll 20 may be disposed contrarily to the positions shown in FIG. 8. As an alternative to this, the pressing roll 20 may be a heating roll including a heat source. Around the intermediate transferring member 10, there are disposed four photosensitive members 30Y, 30M, 30C and 30B corresponding to yellow, magenta, cyan and black, which are uniformly charged by corresponding chargers 32Y, 32M, 32C and 32B and then exposed to light by a light-beam scanning unit 34 which is turned on/off by a light beam pulse width modulator in response to density signals. Thus, electrostatic latent images are formed. The electrostatic latent images on the respective photosensitive members are developed by corresponding developing units 36Y, 36M, 36C and 36B respectively containing black, yellow, magenta and cyan toners. Thus, digital color toner images expressing densities by the area modulation are formed on the photosensitive members 30Y, 30M, 30C and 30B. The color toner images are sequentially transferred to the intermediate transferring member 10 by the transferring units 38Y, 38M, 38C and 38B. Thus, color toner images are formed on the intermediate transferring member 10.

When recording medium P has been fed from a tray 40, the pressing roll 20 is pressed against the heating roll 22. Then, the intermediate transferring member 10 having the color toner images and the recording medium P are moved between the heating and pressing rolls 22 and 20 in such a manner that their timings are adjusted so as to be pressed and heated. The toner heated to a temperature higher than the softening point is softened and fused so as to penetrate the recording medium P, and then solidified. Thus, transferring and fixing are performed.

The cooling unit 24 disposed downstream of the transferring and fixing position cools the intermediate transferring member 10 and the recording medium 10 which are integrally conveyed from the heating region. As a result, the toner is coagulated and solidified, thus generating strong adhesiveness with the recording medium P. Also the transparent resin of the recording medium is solidified so that offset is prevented. The intermediate transferring member 10 and the recording medium P are moved to a roll 29 having a small curvature radius. Thus, the rigidity of the recording medium P causes the recording medium P to be separated from the intermediate transferring member 10 together with the toner. As a result, a color image is formed.

The surface of the toner image transferred and fixed to the recording medium P and that of the recording medium are smoothed and flattened by the surface of the intermediate transferring member 10 which is moved in a close contact state. Therefore, an image having a uniform surface and exhibiting excellent glossiness is formed.

The photosensitive members 30Y, 30M, 30C and 30B of the image forming apparatus for use in the method according to the present invention may be known members. For example, various inorganic photosensitive members (Se, a-Si, a-SiC, CdS or the like) and various organic photosensitive members may be employed.

The photosensitive members 30Y, 30M, 30C and 30B were operated so that images were formed by using the recording mediums shown in Table 1 and toners shown in Table 2. The quantity of each toner on the recording medium was 0.65 mg/cm$^2$.

The diameter of the light beam for use by the light-beam scanning unit 34 was 20 μm so that an image having high contrast is obtained.

The intermediate transferring member 10 had a two-layered structure consisting of a base layer and a surface layer. The base layer was formed by a polyimide film to which carbon black was added and which had a thickness of 70 μm. To electrostatically transfer the toner image from the photosensitive member to the intermediate transferring member without disorder of the image, the volume resistivity of the base layer was, in this embodiment, adjusted to $10^{10}$ Ωcm by changing the quantity of the carbon black which was added.

Although the base. layer according to this embodiment was the polyimide film having the thickness of 70 μm, for example, a sheet having a thickness of 10 μm to 300 μm and having excellent heat resistance may be employed. The base layer may be a polymer sheet made of polyester, polyethylene terephthalate, polyether sulfon, polyether ketone, polysulfon, polyimide, polyimideamide or polyamide.

To electrostatically transfer the toner image from the photosensitive member to the intermediate transferring member without disorder of the image, the volume resistivity of the surface layer was adjusted to be $10^{14}$ Ωcm. To satisfactorily bring the intermediate transferring member and the recording medium into contact with each other while interposing the toner image when the simultaneous transference and fixation are performed from the intermediate transferring member to the recording medium, an elastic layer made of silicon copolymer having rubber hardness of 40 degrees and a thickness of 50 μm was provided. The silicon copolymer has elasticity and its surface has tackiness with respect to toner at room temperature. Moreover, it has a characteristic enabling melted and fluidized toner to easily be separated to efficiently shift the toner to the recording medium. Therefore, the silicon copolymer is an optimum material to form the surface layer of the intermediate transferring member.

The surface layer may be formed by a resin layer having a thickness of, for example, 1 μm to 100 μm and exhibiting excellent releasing characteristic. For example, tetrafluoroethylene-perfluoroalkyvinylether copolymer, polytetrafluoroethylene or the like may be employed.

The heating and pressuring roll may be a metal roll or a roll comprising a metal roll on which a heat resisting elastic layer, such as silicon rubber, is provided. The heating roll included a heat source set and controlled to raise the temperature to be higher than the softening point (Tmt) of the toner upstream in which the intermediate transferring member transferred and fixed the toner to the recording medium. The heating region was determined in such a manner that the photosensitive member 1, the toner image and the recording paper P can be brought into close contact with one another in the heating region without generation partial loosening and cease and shift of the recording medium P. The preferred nipping pressure is $1\times10^3$ Pa $1\times10^6$ Pa. In this embodiment, the pressing roll was a roll in the form that silicon rubber having hardness of 55 degrees and a thickness of 3 mm is applied to the surface of an aluminum hollow roll. The heat source in the heating roll was a halogen lamp. The nipping pressure was $5.0\times10^5$ Pa.

In this embodiment, the gas capacity of the cooling unit 24 was adjusted to make the temperature of the surface of the recording medium which is brought into contact with the intermediate transferring member to be 70° C. when the recording medium was separated from the intermediate transferring member.

The moving speed of each of the intermediate transferring member and the toner image was 160 mm/s, a vertical multiline screen was employed which had 200 lines.

[Evaluation of Images]

The glossiness, the color developing characteristic, graininess and irregularity of colors of the toner images formed by the above-mentioned method were evaluated.

The glossiness, the color developing characteristic, graininess and irregularity of colors were evaluated in such a way that patches in Y (yellow), M (magenta), C (cyan), K (black), R (red), G (green), B (blue) and PB (three colors and black) having size of 2 cm×2 cm were output in steps of 10% from input image area ratio of 0% to 100%. Then, glossiness, the color developing characteristic, graininess and irregularity of colors were visually evaluated in accordance with the following criteria.

(Criteria for Evaluating Image)

○: excellent

Ω: satisfactory

Δ: allowable (allowable level)

×: unsatisfactory (not allowable)

1 to 8 and Comparative Examples 1 to 4)

Recording mediums P1 to P6 and the toners A and B were combined variously so that images were formed by the above-mentioned procedure [Image Recording 1]. Results of evaluation of obtained images in accordance with the foregoing criteria are shown in Table 3.

Recording mediums OHP1 to OHP3 and the toner A were combined variously so that images were formed similarly to the foregoing case. Results of evaluation of formed images in accordance with the following criteria are shown in Table 4.

TABLE 3

| | Toner | Recording Medium | Tmp-Tmt (° C.) | Uniformity of Glossiness | Color Developing Characteristic | Graininess | Irregularity of color |
|---|---|---|---|---|---|---|---|
| Example 1 | Toner A | P1 | −24 | ◎ | ◎ | ○ | ○ |
| Example 2 | | P2 | −23 | ◎ | ◎ | ○ | ○ |
| Example 3 | | P3 | −13 | ◎ | ◎ | ○ | ○ |
| Example 4 | | P4 | −1 | ○ | ○ | ○ | ○ |
| Comparative Example 1 | | P5 | +16 | X | X | ○ | ○ |
| Comparative Example 2 | | P6 | +27 | X | X | ○ | ○ |
| Comparative Example 3 | Toner B | P1 | −53 | ○ | ○ | X | ○ |
| Example 5 | | P4 | −30 | ○ | ○ | ○ | ○ |
| Example 6 | | P6 | −2 | Δ | Δ | ○ | ○ |

TABLE 4

| | Toner | Recording Medium | Tmp-Tmt (° C.) | Color Developing Characteristic When Projected |
|---|---|---|---|---|
| Example 7 | Toner A | OHP 1 | −24 | ○ |
| Example 8 | Toner A | OHP 2 | −13 | ○ |
| Comparative Example 4 | Toner A | OHP 3 | +27 | x |

As a result, Examples 1 to 5 employing [Image Recording 1 ] which was the image forming method according to the present invention, and arranged such that the softening point (Tmp) of the thermoplastic polyester resin formed on the surface of the recording medium was in the range from −1° C. to −30° C. from the softening point (Tmt) of the toner, the weight average molecular weight (Mw) of the thermoplastic polyester resin formed on the surface of the recording medium was 5,000 to 60,000, the number average molecular weight of the same was 2,000 to 5,000 and Mw/Mn was 2 to 15 enabled images exhibiting excellent color developing characteristic to be obtained which had uniform glossiness in the overall image area ratio region, which were free from irregularity of colors and which had satisfactory graininess without fine irregularity of glossiness. Examples 7 to 8 having similar ranges resulted in excellent color developing characteristic when projected by using an OHP and sharp images free from turbidity being formed. Example 6 according to the present invention and having Mw, Mn and Mw/Mn did not satisfy the preferred ranges resulted in the uniformity of the glossiness and color developing characteristics being allowable and somewhat unsatisfactory as compared with the other examples each having the preferred molecular weight although an image exhibiting excellent graininess free from fine irregularity of glossiness was obtained.

Comparative Examples 1 to 4 having Tmp–Tmt which did not satisfy the range according to the present invention were unsatisfactory in the uniformity of the glossiness with respect to the image area ratio and had unsatisfactory color developing characteristic and graininess.

Figure 9:
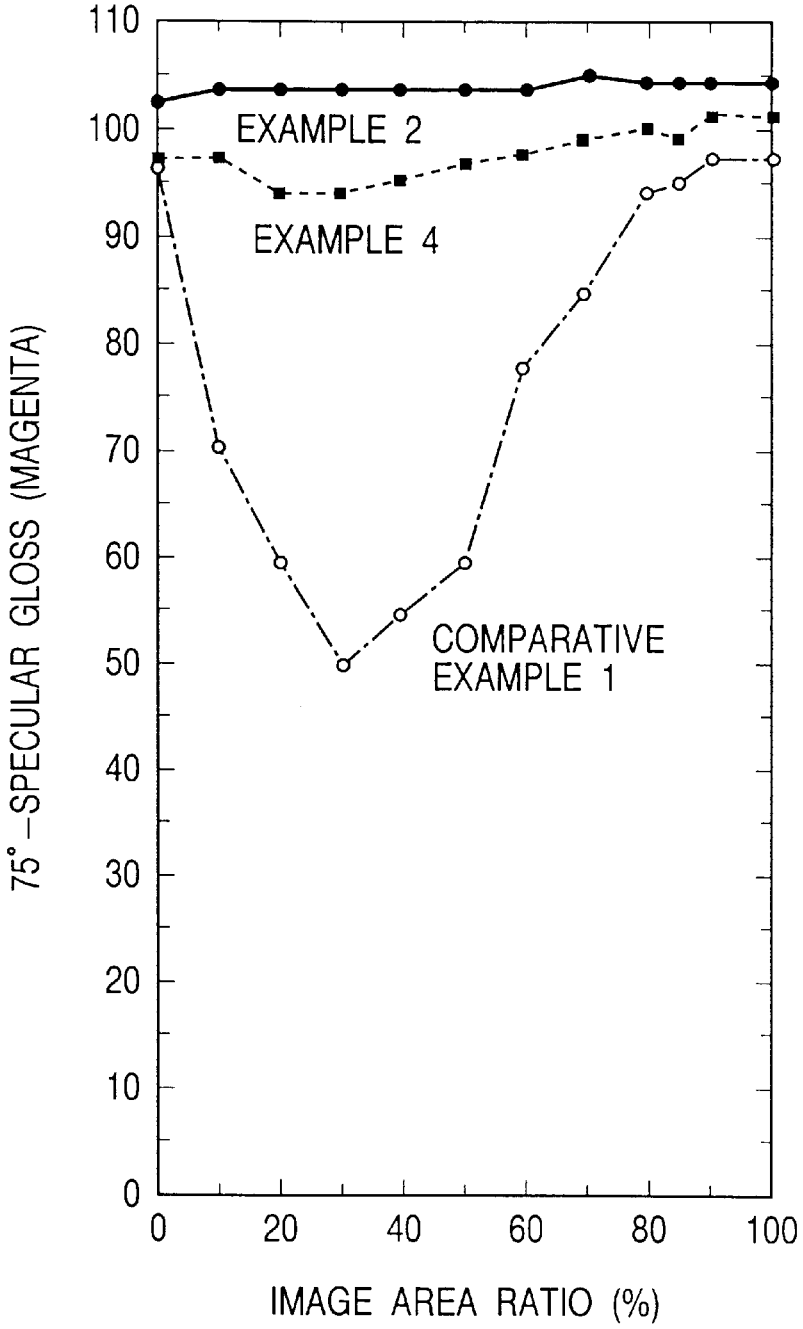
FIG. 9 is a graph showing the relationship between the image area ratios and glosses according to examples of the present invention and comparative examples.

FIG. 9 show results of 75-degree relative-specular glossiness of the paper portion of each of Examples 2 and 4 and Comparative Example 1 and each input image area ratio, as examples of results. As compared with the comparative examples, the gloss of each example does not depend on the image area ratio and uniform images each having excellent glossiness were formed.

[Image Recording 2]

Figure 10:
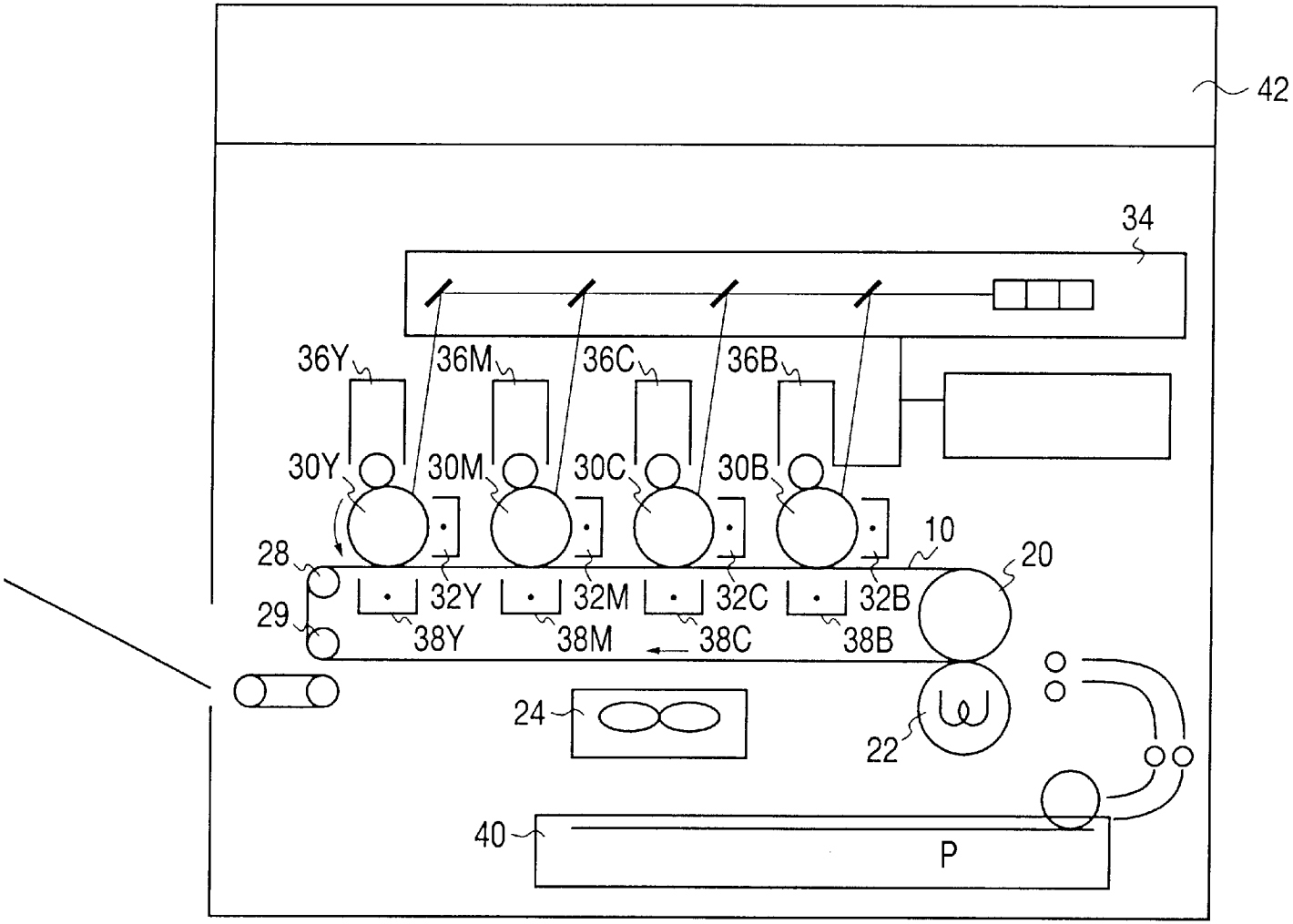
FIG. 10 is a diagram showing the structure of an image forming apparatus for use in [Image Formation 2] in the embodiment.

As shown in FIG. 10, an apparatus 42 similar to the N foregoing case [Image Recording 1] was used except for the positions of the pressing roll 20 and the heating roll 22 being made to be contrary. A similar method to that [Image Recording 1] was employed except for the heating roll 22 being set and controlled to be toner softening point (Tmt) +30° C. Thus, images were formed. FIG. 10 is a diagram showing the structure of an image forming apparatus 42 which is adapted to the image forming method [Image Recording 2] according to this embodiment.

(Examples 9 to 12 and Comparative Examples 5 and 6)

Recording mediums P1 to P6 and the toner A were combined so that images were formed by the procedure described in [Image Recording 2]. Results of evaluation of obtained images in accordance with the above-mentioned criteria are shown in Table 5.

TABLE 5

| | Toner | Recording Medium | Tmp-Tmt (° C.) | Uniformity of Glossiness | Color Developing Characteristic | Graininess | Irregularity of Color |
|---|---|---|---|---|---|---|---|
| Example 9 | Toner | P1 | −24 | ○ | ○ | ○ | ○ |
| Example 10 | A | P2 | −23 | ○ | ○ | ○ | ○ |
| Example 11 | | P3 | −13 | ○ | ○ | ○ | ○ |
| Example 11 | | P4 | −1 | Δ | Δ | ○ | ○ |
| Comparative Example 5 | | P5 | +16 | X | X | ○ | ○ |
| Comparative Example 6 | | P6 | +27 | X | X | ○ | ○ |

Images formed in Examples 9 to 12 had excellent graininess without fine irregularity of glossiness. Moreover, satisfactory uniformity of glossiness and color developing characteristic were obtained. However, the irregularity of the glossiness and color developing characteristic somewhat deteriorated as compared with Examples 1 to 5 in which the intermediate transferring member and the toner image were brought into close contact with the heating roll so that the toner image was heated to be higher than the softening point of the toner at a position upstream of the nipping position between the heating roll and the pressing roll. That is, fact can be understood that heating of the toner image at a position upstream of the transferring position enables specially excellent image to be formed among the examples of the manufacturing method according to the present invention.

[Manufacturing Recording Medium 2]

Recording mediums were manufactured by a method similarly to the method of manufacturing recording medium P2 according to Example 2 except for phosphate being previously mixed with polyester PE2 by 0.1 part by weight, 0.2 part by weight, 0.4 part by weight and 1 part by weight with respect to 80 parts by weight of ethyl acetate and 20 parts by weight of polyester PE2 when polyester PE2 for use in the recording medium P2 was applied to paper which was the base of recording medium in order to adjust the electric resistance of the recording medium. The recording mediums were given sample numbers P7, P8, P9 and P10. The softening points (Tmp) of the resins respectively were 90° C., 90° C., 89° C. and 88° C.

(Examples 13 to 16)

Results of measurement of the angle of contact between the recording medium P2 and the recording mediums P7, P8, P9 and P10 obtained in [Manufacturing Recording Medium 2] and toner A by a method similar to that described in the detailed description of the invention are shown in Table 6.

The foregoing recording mediums and the toner A were combined one another so that images were formed by the procedure described in [Image Recording 2]. Results of evaluation of the obtained images in accordance with the above-mentioned criteria are shown in Table 6.

TABLE 6

| | Toner | Recording Medium | Phosphate | Tmp-Tmt (° C.) | Contact Angle With Toner | Uniformity of Glossiness | Color Developing Characteristic | Graininess | Irregularity of Colors |
|---|---|---|---|---|---|---|---|---|---|
| Example 2 | Toner | P2 | 0 | −23 | 25 | ◎ | ◎ | ○ | ○ |
| Example 13 | A | P7 | 0.1 | −23 | 30 | ◎ | ◎ | ○ | ○ |
| Example 14 | | P8 | 0.2 | −23 | 40 | ○ | ○ | ○ | ○ |
| Example 15 | | P9 | 0.4 | −24 | 59 | Δ | Δ | ○ | ○ |
| Example 16 | | P10 | 1.0 | −25 | 65 | Δ | Δ | ○ | ○ |

*Contents were indicated with parts by weight.

As shown in Table 6, Examples 2, 13 and 14 arranged such that the softening point (Tmp) of the thermoplastic polyester resin formed on the surface of the recording medium was in the range from −1° C. to −30° C. from the softening point (Tmt) of the toner, the weight average molecular weight (Mw) of the thermoplastic polyester resin formed on the surface of the recording medium was 5,000 to 60,000, the number average molecular weight of the same was 2,000 to 5,000 and Mw/Mn and the angle of contact with the toner was 40 degrees or smaller enabled images exhibiting excellent color developing characteristic to be obtained which had uniform glossiness in the overall image area ratio region, which were free from irregularity of colors and which had satisfactory graininess without fine irregularity of glossiness. Examples 15 and 16 using the recording mediums each having the transparent resin layer having a large angle of contact with the toner and small compatibility resulted in allowable uniformity of glossiness and color developing characteristic which were relatively inferior to those of the other examples although images exhibiting excellent color developing characteristic were obtained because of satisfactory graininess without fine irregularity of the glossiness. Among the foregoing examples, Example 2 exhibited most satisfactory results which did not contain the surface active agent in the transparent resin layer formed on the surface and which had the smallest angle of contact.

As can be understood from the above-mentioned examples and comparative examples, the image forming method according to the present invention enabled the image exhibiting excellent color developing characteristic and high quality to be obtained such that disorder of the transferring electric field and deterioration in the quality of halftone image considered to occur owning to coulomb repulsion were prevented, a satisfactory transferring rate was realized, uniform image glossiness was obtained in the recording medium and the image regions including highlighted regions, intermediate density regions and high density regions, excellent graininess was obtained, a satisfactory color balance was realized and excellent transparency of the toner was obtained.

The image forming method according to the present invention is able to be applied when an image is formed by a printer or a copying machine.

According to the present invention, the above-mentioned image forming method is provided. Regardless of the density of the image and the image area ratio, excellent effects can be obtained such that the formed image is able to have the same glossiness as that of the recording medium, excellent color reproducibility can be obtained, generation of irregular color can be prevented, satisfactory graininess can be obtained, fine irregularity of glossiness can be prevented and uniform gloss of the image can be obtained. The image forming apparatus according to the present invention can be applied to the above-mentioned image forming method. As a result, an image having an excellent quality can easily be formed. The recording medium according to the present invention has the surface layer having excellent compatibility with the toner. When the recording medium according to the present invention is used, effects can be obtained in that an image can be formed which has uniform glossiness, satisfactory color reproducibility can be realized, generation of irregular color can be prevented and excellent graininess can be realized.

What is claimed is:

1. An image forming method, comprising the steps of:

carrying a toner image with a toner image holding member into close contact with a recording medium; and transferring and fixing the toner image while heating the toner image, wherein a recording medium has a thermoplastic transparent resin layer on at least a surface of a base thereof on which the toner image is transferred and softening point (Tmp) of said transparent resin is from 1° C. to 30° C. lower than the softening point (Tmt) of the toner, the recording medium having an angle of contact of 40° or smaller between the resin material forming said transparent resin layer and said toner which is in a molten state.

2. The image forming method of claim 1, further comprising:

the step of preheating the toner image held by said toner image holding member in such a manner that the temperature of the surface of the toner image is not lower than a softening point (Tmt) of the toner before the toner image is carried to the toner image transferring position.

3. The image forming method of claim 1, further comprising:

the step of separating the recording medium from the toner image holding member at a position downstream of a toner image transferring position after the surface temperature of the transparent resin layer of said recording medium has been made to be lower than the softening point (Tmp) of said transparent resin by 10° C. or more.

4. The image forming method of claim 1, wherein weight average molecular weight (Mw) of a resin material forming said transparent resin layer is in the range from 5,000 to 60,000, number average molecular weight (Mn) of the same is in the range from 2,000 to 5,000 and Mw/Mn is in the range from 2 to 15.

5. The image forming method of claim 1, wherein a resin material forming said transparent resin layer contains polyester resin type component units.

6. An image forming apparatus, comprising:

means for forming a toner image;

a toner image holding member for holding and carrying the formed toner image from a predetermined toner image forming position to a predetermined toner image transferring position; and transferring and fixing means for transferring the toner image carried to the toner image transferring position to a predetermined recording medium; wherein at least either said toner image holding member or said transferring and fixing means is, at said toner image transferring position, provided with heating and pressing means for, by using heat energy, transferring and fixing the toner image to a transparent resin layer of the recording medium having a thermoplastic transparent resin layer on at least a surface of a base on which the toner image is transferred, said transparent resin layer containing transparent resin having a softening point (Tmp) from 1° C. to 30° C. lower than the softening point (Tmt) of said toner, and wherein the recording medium has an angle of contact of 40° or smaller between a resin material forming said transparent resin layer and said toner which is in a molten state.

7. The image forming apparatus of claim 6, wherein cooling means for cooling the surface temperature of transparent resin of said recording medium to be lower than the softening point (Tmp) of the transparent resin by 10° C. or more is provided downstream of said toner image transferring position and upstream of a position at which the recording medium is separated from the toner image holding member.

8. An image forming apparatus, comprising:

means for forming a toner image;

a toner image holding member for holding and carrying the formed toner image from a predetermined toner image forming position to a predetermined toner image transferring position; and transferring and fixing means for transferring the toner image carried to the toner image transferring position to a predetermined recording medium, wherein at least either said toner image holding member or said transferring and fixing means is, at said toner image transferring position, provided with heating and pressing means for transferring and fixing the toner image, and heating means for heating the surface temperature of the toner image held on said toner image holding member to be higher than the softening point (Tmt) of the toner before the toner image reaches the toner image transferring portion, and wherein the recording medium has an angle of contact of 40° or smaller between a resin material forming a transparent resin layer and said toner which is in a molten state.

9. The image forming apparatus of claim 8, wherein cooling means for cooling the surface temperature of transparent resin of said recording medium to be lower than the softening point (Tmp) of the transparent resin by 10° C. or more is provided downstream of said toner image transferring position and upstream of a position at which the recording medium is separated from the toner image holding member.

10. A recording medium, comprising:

a thermoplastic transparent resin layer on at least a surface of a base on which an image is recorded, wherein the softening point (Tmp) of a resin material forming said transparent resin layer is from 1° C. to 30° C. lower than the softening point (Tmt) of toner for use to form a toner image which is recorded, and wherein an angle of contact between a resin material forming said transparent resin layer and said toner which is in a molten state is 40° or smaller.

11. The recording medium of claim 9, wherein the softening point (Tmp) of a resin material forming said transparent resin layer is from 1° C. to 30° C. lower than the softening point (Tmt) of said toner.

12. The recording medium of claim 10, wherein weight average molecular weight (Mw) of a resin material forming said transparent resin layer is in the range from 5,000 to 60,000, number average molecular weight (Mn) of the same is in the range from 2,000 to 5,000 and Mw/Mn is in the range from 2 to 15.

13. The recording medium of claim 10, wherein a resin material forming said transparent resin layer contains polyester resin type component units.

14. The recording medium of claim 10, wherein the thickness of said transparent resin layer is 2 $\mu$m to 20 $\mu$m.

15. The recording medium of claim 10, wherein said base is made of a non-transparent material.

16. The recording medium of claim 10, wherein a white pigment layer is provided on the surface of said base and said transparent resin layer is provided on the surface of said white pigment layer.

17. A recording medium comprising:

a thermoplastic transparent resin layer on at least a surface of a base on which an image is recorded, wherein weight average molecular weight (Mw) of a resin material forming said transparent resin layer is in the range from 5,000 to 60,000, number average molecular weight (Mn) of the same is in the range from 2,000 to 5,000 and Mw/Mn is in the range from 2 to 15.

* * * * *